US008033232B2

(12) United States Patent
Hayakawa et al.

(10) Patent No.: US 8,033,232 B2
(45) Date of Patent: Oct. 11, 2011

(54) EMBROIDERY DATA PROCESSING APPARATUS, SEWING MACHINE EQUIPPED WITH THE EMBROIDERY DATA PROCESSING APPARATUS, AND COMPUTER-READABLE RECORDING MEDIUM WITH RECORDED EMBROIDERY DATA PROCESSING COMPUTER PROGRAM

(75) Inventors: Atsuya Hayakawa, Chita (JP); Satoru Makino, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1049 days.

(21) Appl. No.: 11/902,927

(22) Filed: Sep. 26, 2007

(65) Prior Publication Data

US 2008/0078312 A1 Apr. 3, 2008

(30) Foreign Application Priority Data

Sep. 28, 2006 (JP) ..... 2006-264279

(51) Int. Cl.
*D05B 19/00* (2006.01)

(52) U.S. Cl. ..... 112/470.04; 112/470.01

(58) Field of Classification Search ..... 700/136–138; 112/102.5, 470.01, 470.04, 453, 475.09, 112/475.18, 475.19

See application file for complete search history.

(56) References Cited

U.S. PATENT DOCUMENTS

| | | | | |
|---|---|---|---|---|
| 5,855,176 | A * | 1/1999 | Takenoya et al. | 112/102.5 |
| 7,058,471 | B2 * | 6/2006 | Watanabe | 112/475.09 |

FOREIGN PATENT DOCUMENTS

| | | |
|---|---|---|
| JP | U-64-013575 | 1/1989 |
| JP | A-01-126995 | 5/1989 |
| JP | B2-06-067422 | 8/1994 |
| JP | A-09-269966 | 10/1997 |
| JP | A-11-004984 | 1/1999 |
| JP | A-11-015377 | 1/1999 |
| JP | A-2000-008269 | 1/2000 |
| JP | A-2004-118404 | 4/2004 |

* cited by examiner

*Primary Examiner* — Nathan Durham
(74) *Attorney, Agent, or Firm* — Oliff & Berridge, PLC

(57) ABSTRACT

An embroidery data processing apparatus which may be used to attach an IC tag to a work cloth without impairing a design of the work cloth. The embroidery data processing apparatus may determine an IC tag area based on a size and shape of the IC tag, and may determine whether the IC tag area can be included in an embroidery area that is determined on the basis of embroidery data. If the IC tag area can be included in the embroidery area, the positions of the embroidery area and the IC tag area may be set in an embroiderable area of a sewing machine in such a manner that the IC tag area is positioned in the embroidery area.

24 Claims, 31 Drawing Sheets

EMBROIDERY DATA PROCESSING APPARATUS, SEWING MACHINE EQUIPPED WITH THE EMBROIDERY DATA PROCESSING APPARATUS, AND COMPUTER-READABLE RECORDING MEDIUM WITH RECORDED EMBROIDERY DATA PROCESSING COMPUTER PROGRAM

CROSS-REFERENCE TO RELATED APPLICATION

The present application claims priority from Japanese Patent Application No. 2006-264279, which was filed on Sep. 28, 2006, the disclosure of which is herein incorporated by reference in its entirety.

BACKGROUND

The present disclosure relates generally to technical fields including an embroidery data processing apparatus that processes embroidery data used in embroidering by use of a sewing machine capable of embroidering, a sewing machine equipped with the embroidery data processing apparatus, and a computer-readable recording medium with a recorded embroidery data processing computer program.

In the related art, a technology is known for utilizing an optically-readable mark attached to a work cloth in production of the work cloth, management of products for sales of the products, or display of a quality of the work cloth.

This mark is directly printed to a fabric or printed beforehand to a piece of paper or cloth which is to be attached to the fabric subsequently. In such cases, depending on the handling of the fabric, the mark can be partially or totally lost or separated due to water and chemicals used in various processing steps. To solve this problem, a sewing machine has been proposed which forms an optically-readable mark by sewing it to the work cloth (see Japanese Patent Application Laid Open Publication No. Hei 6-67422). The mark that is sewn to the work cloth by the sewing machine generally has low occurrence of being lost or separated from the work cloth, and may also be protected from deformation.

SUMMARY

However, when a mark is directly sewn to the work cloth, the mark may badly affect the appearance and design of the work cloth. Also, generally an amount of information that can be added to the mark formed by sewing is not sufficient, and there is a desire to give much more information to the work cloth.

It is one object of the present disclosure to provide an embroidery data processing apparatus that can attach an IC tag (i.e., integrated circuit) capable of storing a lot of information to a work cloth without impairing a design of the work cloth, a sewing machine equipped with the embroidery data processing apparatus, and a computer-readable recording medium in which an embroidery data processing computer program is stored.

According to a first aspect of the present disclosure, there is provided an embroidery data processing apparatus which processes embroidery data used to embroider an embroidery pattern on a work cloth by using a sewing machine capable of embroidering, the embroidery data processing apparatus comprising: an IC tag area acquisition device that acquires an IC tag area which is determined on the basis of a size and shape of an IC tag; a determination device that determines whether the IC tag area can be included in an embroidery area which is determined on the basis of the embroidery data; and a location setting device that, if the determination device determines that the IC tag area can be included in the embroidery area, sets positions of the embroidery area and the IC tag area in an embroiderable area of the sewing machine in such a manner that the IC tag area may be positioned in the embroidery area.

According to a second aspect of the present disclosure, there is provided an embroidery data processing apparatus which processes embroidery data used to embroider an embroidery pattern on a work cloth by using a sewing machine capable of embroidering, the embroidery data processing apparatus comprising: an IC tag area acquisition device that acquires an IC tag area which is determined on the basis of a size and shape of an IC tag; a location specification device that specifies positions of the IC tag area and an embroidery area which are determined on the basis of the embroidery data in an embroiderable area of the sewing machine; a determination device that determines whether the IC tag area positioned to the position specified by the location specification device is included in the embroidery area positioned at the position specified by the location specification device; and a location setting device that, if the determination device determines that the IC tag area is included in the embroidery area, sets positions of the embroidery area and the IC tag area in the embroiderable area of the sewing machine to the positions specified by the location specification device.

According to a third aspect of the present disclosure, there is provided a computer-readable recording medium storing an embroidery data processing computer program which processes embroidery data used to embroider an embroidery pattern on a work cloth by using a sewing machine capable of embroidering, the program comprising: IC tag area acquisition instructions for acquiring an IC tag area which is determined on the basis of a size and shape of an IC tag; determination instructions for determining whether the IC tag area can be included in an embroidery area which is determined on the basis of the embroidery data; and location setting instructions for setting positions of the embroidery area and the IC tag area in an embroiderable area of the sewing machine in such a manner that the IC tag area is located in the embroidery area, if during execution of the determination instructions, it is determined that the IC tag area can be included in the embroidery area.

According to a fourth aspect of the present disclosure, there is provided a computer-readable recording medium storing an embroidery data processing computer program which processes embroidery data used to embroider an embroidery pattern on a work cloth by using a sewing machine capable of embroidering, the program comprising: IC tag area acquisition instructions for acquiring an IC tag area which is determined on the basis of a size and shape of an IC tag; location specification instructions for specifying positions of the IC tag area and an embroidery area which are determined on the basis of the embroidery data in an embroiderable area of the sewing machine; determination instructions for determining whether the IC tag area positioned at the position specified during execution of the location specification instructions is included in the embroidery area positioned at the position specified during execution of the location specification instructions; and location setting instructions for setting the positions of the embroidery area and the IC tag area in the embroiderable area of the sewing machine to the positions specified during execution of the location specification instructions if, during execution of the determination instructions, it is determined that the IC tag area can be included in the embroidery area.

BRIEF DESCRIPTION OF THE DRAWINGS

Exemplary embodiments will be described in detail with reference to the accompanying drawings in which.

DETAILED DESCRIPTION OF EMBODIMENTS

Exemplary embodiments of the broad principles outlined herein are described. The following will sequentially describe various embodiments of an embroidery data processing apparatus, with reference to the drawings. First, the embroidery data processing apparatus of a first embodiment will be described below. The embroidery data processing apparatus according to the first embodiment may be integrated with a sewing machine that forms stitches to a work cloth by moving the work cloth relative to a needle moving vertically. It should be noted that the embroidery data processing apparatus may be separated from the sewing machine. First, a physical configuration and an electrical configuration of a sewing machine 1 according to the first embodiment will be described below.

First, the physical configuration of the sewing machine 1 will be described below with reference to FIG. 1.

Figure 1:
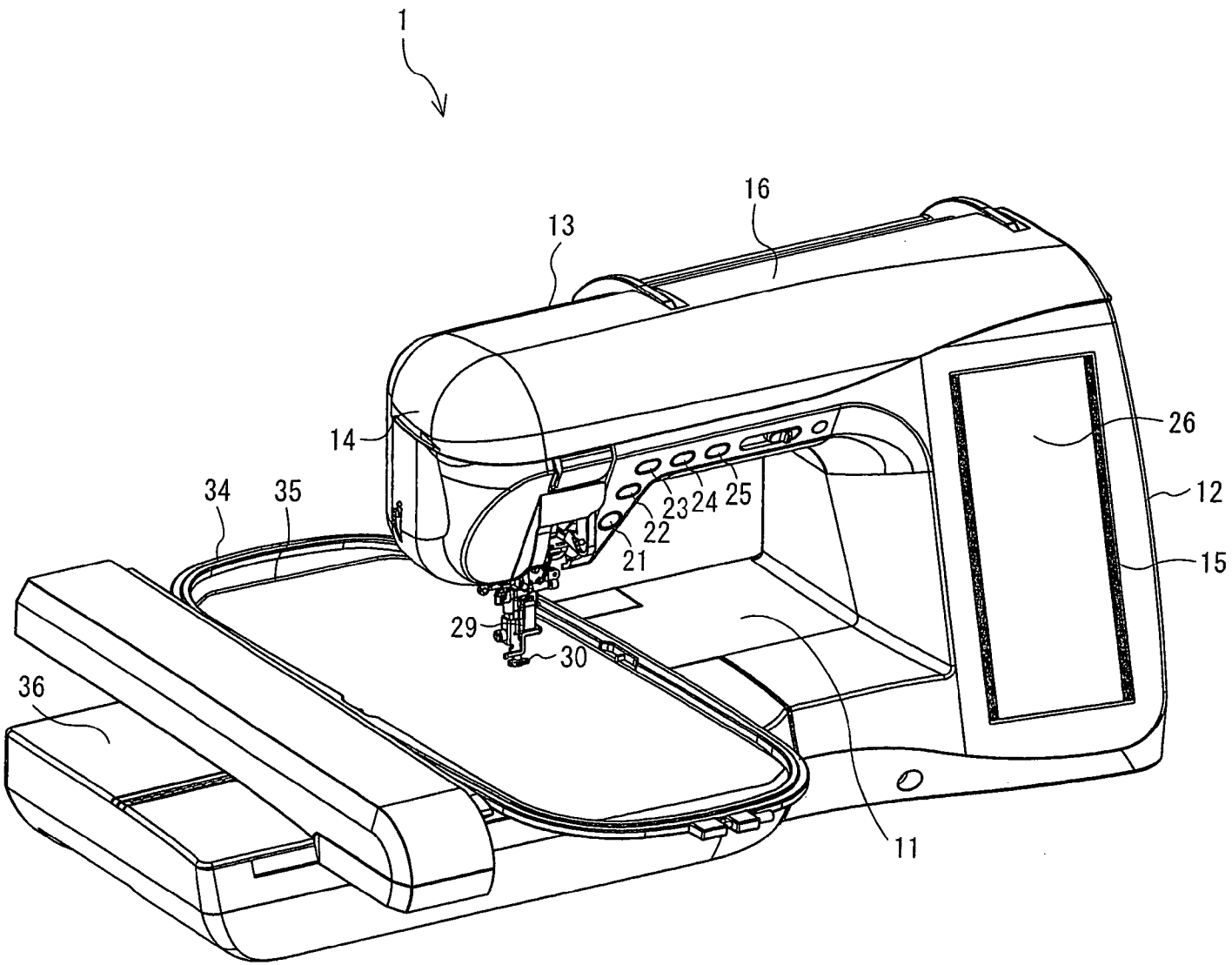
FIG. 1 is a perspective view of a sewing machine.

As shown in FIG. 1, the sewing machine 1 may have the horizontally long sewing machine bed 11, a pillar 12 erected upward at the right end of the sewing machine bed 11, an arm portion 13 extending leftward from the upper end of the pillar 12 in FIG. 1, and a head portion 14 provided at the left end of the arm portion 13. The sewing machine bed 11 may be loaded with an embroidery frame 34 that may frame a work cloth (not shown). The embroidery frame 34 may be arranged to be moved by an embroidery frame movement mechanism 36 to an arbitrary position based on an X-Y coordinate system intrinsic to the apparatus. As the work cloth is arbitrarily moved by the embroidery frame movement mechanism 36, a needle bar and a shuttle mechanism (not shown), may be driven to carry out an embroidery formation operation that may form predetermined stitches or embroidery to the work cloth.

Further, the head portion 14 may be equipped with a needle bar mechanism (not shown), which may vertically drive a needle bar (not shown), mounted with a sewing needle 29, a needle bar swinging pulse motor 80 (see FIG. 2) which swings the needle bar horizontally, and a thread take-up mechanism (not shown). The embroidery frame movement mechanism 36 and the needle bar may be controlled on the basis of embroidery data by a control unit which may include a microcomputer etc. built in the sewing machine 1. Further, although not shown in FIG. 1, an image scanner sensor 27 (see FIG. 2) capable of scanning a size and shape of an IC tag located in an embroiderable area inside an inner periphery 35 of the embroidery frame may be attached to a lower surface of the head portion 14 near the needle bar. The image scanner sensor 27 may include, for example, a CCD sensor or a CMOS sensor.

An LCD (liquid crystal display) 15 having a vertically long rectangular shape may be attached to a front surface of the pillar 12. The LCD 15 may indicate various patterns and function names for performing various functions used in sewing as well as a variety of messages. A touch panel 26 is attached on a front surface of LCD 15. The touch panel 26 may respond to the display positions of various settings such as settings of pattern names of a plurality of patterns and function names for performing various functions, numerical settings of a feed amount of the work cloth by means of a feed adjustment pulse motor 78 (see FIG. 2) and a needle swing amount by means of the needle bar swinging pulse motor 80. Accordingly, by pressing portions on the touch panel 26 that correspond to the patterns and the settings on the screens displayed on the LCD 15 by using a finger or a dedicated touch pen, it is possible to select a pattern to be sewn, specify desired functions, and set desired numerical values.

Although not shown in FIG. 1, a connector 38 (see FIG. 2) may be provided on a right side surface of the pillar 12 in FIG. 1, which can connect an external storage device 39 such as a memory card. Through the connector 38, various kinds of sewing information data and programs from the external storage device 39 can be input to and output from the sewing machine 1.

Next, a configuration of the arm portion 13 will be described below. The arm portion 13 may include an open/close cover 16 for opening and closing its upper side. Inside the open/close cover 16, a thread spool (not shown) may be included for supplying a thread to the sewing needle 29. Although not shown, a needle thread extending from the thread spool may be supplied to the sewing needle 29 mounted to the needle bar after running through a tensioner and a thread take-up spring which are mounted on the head portion 14 to adjust the thread tension and a plurality of thread hooking portions such as a thread take-up lever which vertically reciprocates to pull up the needle thread.

The arm portion 13 may also include a sewing machine drive shaft (not shown), which extends in the longitudinal direction of the arm portion 13. The sewing machine drive shaft may be driven rotationally by a sewing machine motor 79 (see FIG. 2). The needle bar mechanism and the thread take-up mechanism may be driven by the rotation of the sewing machine drive shaft.

The lower front surface of arm portion 13 may include start/stop switch 21, a reverse stitch switch 22, a needle up/down switch 23, a presser foot elevation switch 24, and an automatic thread hooking start switch 25. The sewing start/stop switch 21 may command starting and stopping of the sewing machine operation, that is, starting and stopping of sewing. The reverse stitch switch 22 may be used to feed the work cloth from the rear side to the front side, which is the opposite of the ordinary direction. The needle up/down switch 23 may switch the upper and lower stopping positions of the needle bar. The presser foot elevation switch 24 may command the elevation of a presser foot 30. The automatic thread hooking start switch 25 may command starting of automatic thread hooking which hooks a thread over the thread take-up lever, the tensioner, and the thread take-up spring and pass the thread through an eye of the sewing needle 29.

Further, the head portion 14 provided at the left end of the arm portion 13 may include the above-described needle bar, thread take-up lever, tensioner, and thread take-up spring as well as an automatic thread hooking apparatus (not shown) and an automatic threading mechanism (not shown). On the rear side of the needle bar, a pressure bar (not shown), is arranged which may be supported by a sewing machine frame in such a manner that it can be raised and lowered. The lower end of the presser bar may include presser foot 30 for pressing the work cloth.

Figure 2:
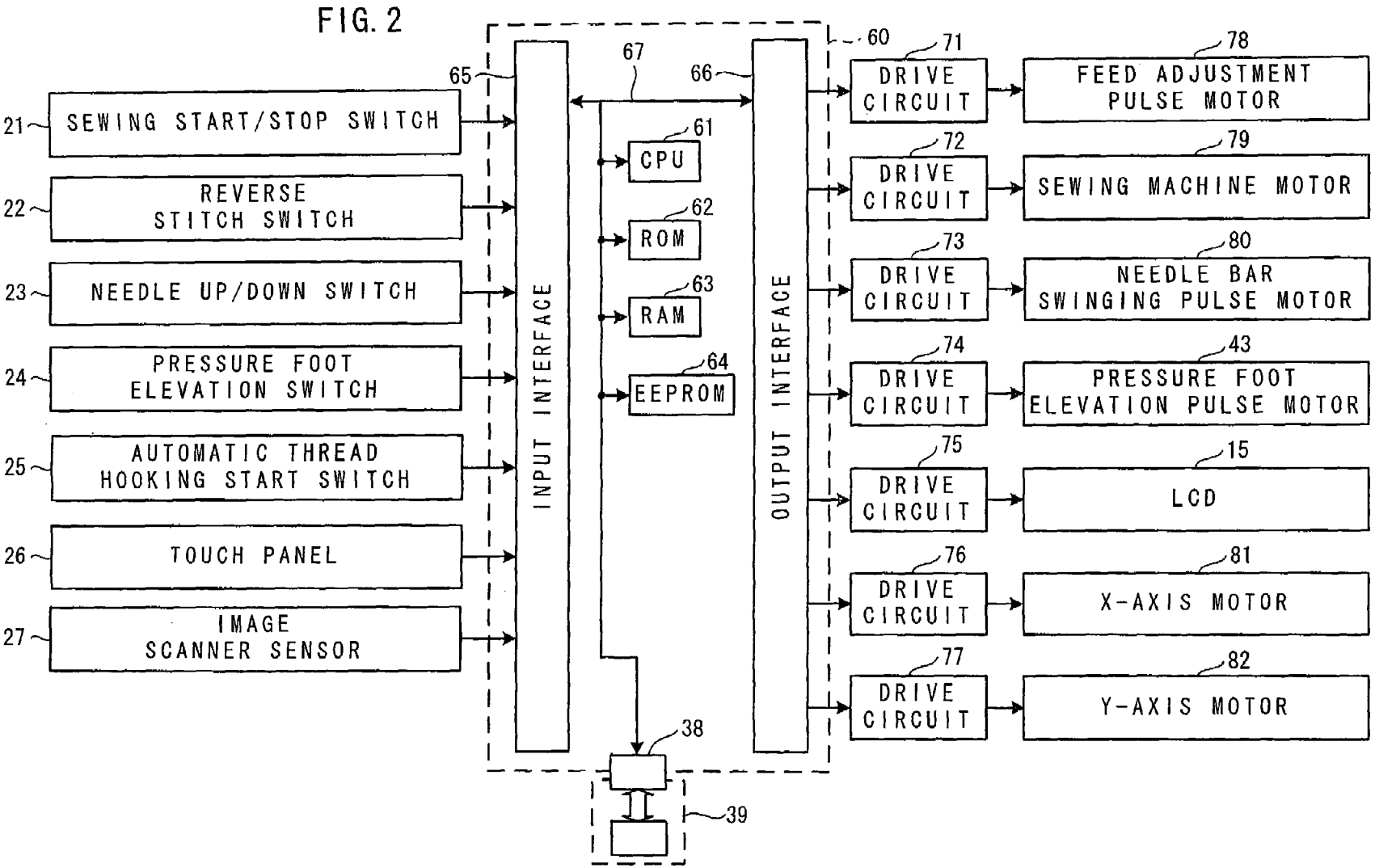
FIG. 2 is a conceptual diagram of an electrical configuration of the sewing machine.
Figure 3:
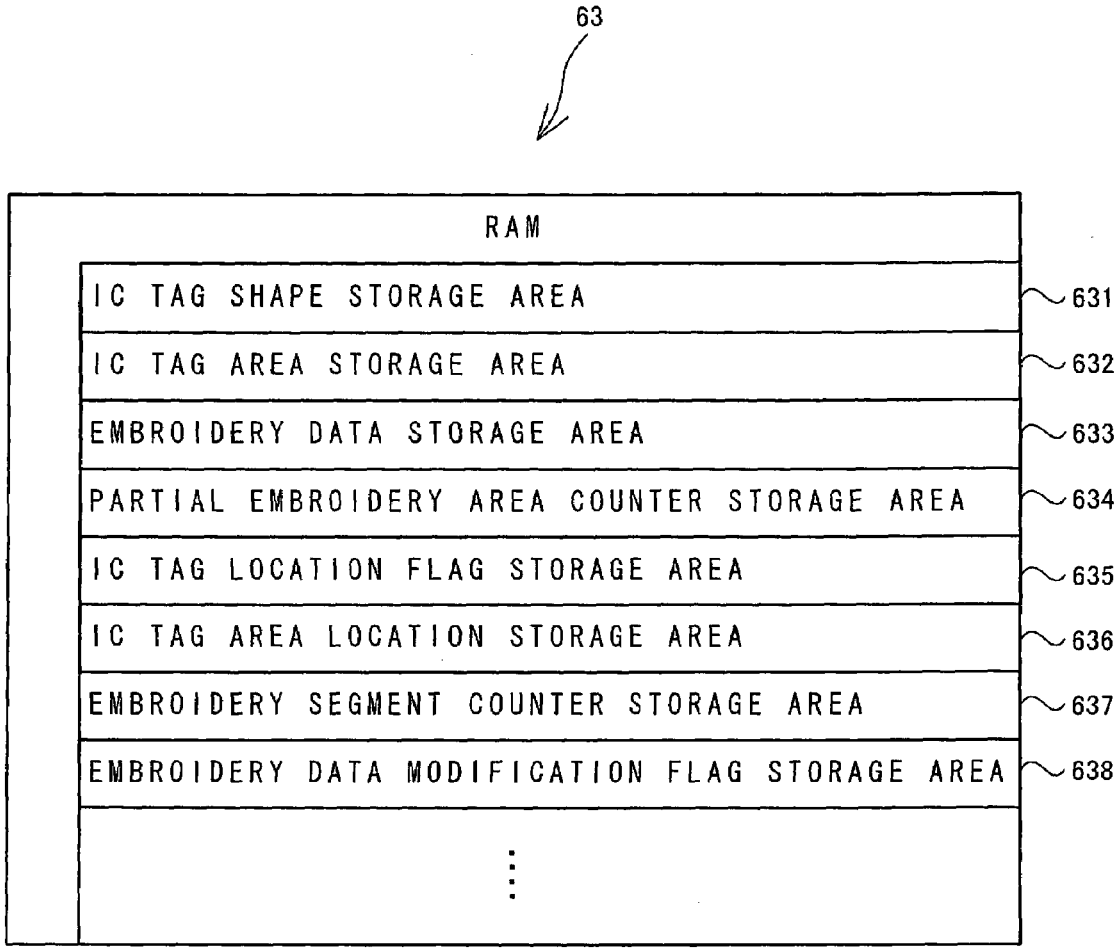
FIG. 3 is a conceptual diagram of storage areas of a RAM.

Next, the electrical configuration of the sewing machine 1 will be described below with reference to FIGS. 2 and 3. As shown in FIG. 2, a control unit 60 of the sewing machine 1 may include a CPU 61, an ROM 62, an RAM 63, an EEPROM 64, an input interface 65, an output interface 66, and the connector 38. These may be connected by a bus 67 to each other. The input interface 65 may be connected with the sewing start/stop switch 21 described above, the reverse stitch switch 22, the needle up/down switch 23, the pressure elevation switch 24, the automatic thread hooking start switch 25, the touch panel 26, and the image scanner sensor 27. On the other hand, the output interface 66 may be electrically connected with the feed adjustment pulse motor 78, the sewing machine motor 79, the needle bar swinging pulse motor 80, a presser foot elevation pulse motor 43, the LCD 15, an X-axis motor 81, and a Y-axis motor 82 via drive circuits 71 through 77 respectively. The feed adjustment pulse motor 78 may adjust a feed amount of the work cloth. The sewing machine motor 79 may rotationally drive the sewing machine drive shaft. The needle bar swinging pulse motor 80 may drive the needle bar (not shown), in a swinging manner. The X-axis motor 81 may drive the embroidery frame 34 in an X-axis direction. The Y-axis motor 82 may drive the embroidery frame 34 in a Y-axis direction. The following will describe in detail the CPU 61, the ROM 62, and the RAM 63 of the control unit 60 of the sewing machine 1.

The CPU 61 may conduct main control on the sewing machine 1, to perform various calculations and processing used in sewing, in accordance with a sewing control program which may be stored in the ROM 62. The CPU 61 may also set positions of an IC tag area and an embroidery area in an embroiderable area in accordance with an embroidery data processing program which may be stored in the ROM 62. It should be noted that a sewing machine operation program may be stored in the external storage device such as a memory card. In this case, however, the program is read into the RAM 63 to be executed.

The ROM 62 may have a sewing control program storage area in which the sewing control program is stored. The sewing control program may include the drive control of the various drive mechanisms, pattern selection control to select various patterns and various display controls. The ROM 62 may also have an embroidery data processing program storage area in which the embroidery data processing program is stored. The embroidery data processing program may set the positions of the IC tag area and the embroidery area in an embroiderable area. It should be noted that these various kinds of sewing information data pieces may be partially or totally stored in the EEPROM 64. Also, the sewing information may be partially or totally stored in the external storage device beforehand, to be read into the sewing machine 1 later.

The RAM 63 is a random access memory. The RAM 63 may have various storage areas as necessary for storing various kinds of sewing information data read from the ROM 62, various kinds of setting read from the EEPROM 64, and results of calculations performed by the CPU 61. The storage areas of the RAM 63 will be described below in detail with reference to FIG. 3. As shown in FIG. 3, the RAM 63 may have an IC tag shape storage area 631 and an IC tag area storage area 632. The IC tag shape storage area 631 may store, as shape data, form information containing a size and shape of an IC tag. The IC tag area storage area 632 may store an IC tag area determined on the basis of the shape data. The RAM 63 may also include an embroidery data storage area 633, a partial embroidery area counter storage area 634, and an IC tag location flag storage area 635. The embroidery data storage area 633 may store embroidery data. The partial embroidery area counter storage area 634 may store a partial embroidery area counter, which is used to read partial embroidery areas described later in sequence. The IC tag location flag storage area 635 may store an IC tag location flag, which is used to determine whether an IC tag can be positioned in an embroiderable area. Further, the RAM 63 may include as an IC tag area location storage area 636, an embroidery segment counter storage area 637, and an embroidery data modification flag storage area 638. The IC tag area location storage area 636 may store a set location of an IC tag area. The embroidery segment counter storage area 637 may store an embroidery segment counter, which may be used to sequentially read embroidery segments. The embroidery data modification flag storage area 638 may store an embroidery data modification flag, which may be used to determine whether embroidery data can be modified.

As described above, the sewing machine 1 may function as an embroidery data processing apparatus of the present disclosure. Next, processing procedures will be described below of various embodiments for setting positions of an IC tag area and an embroidery area in an embroiderable area by using the sewing machine 1 having the above-described configuration.

Figure 4:
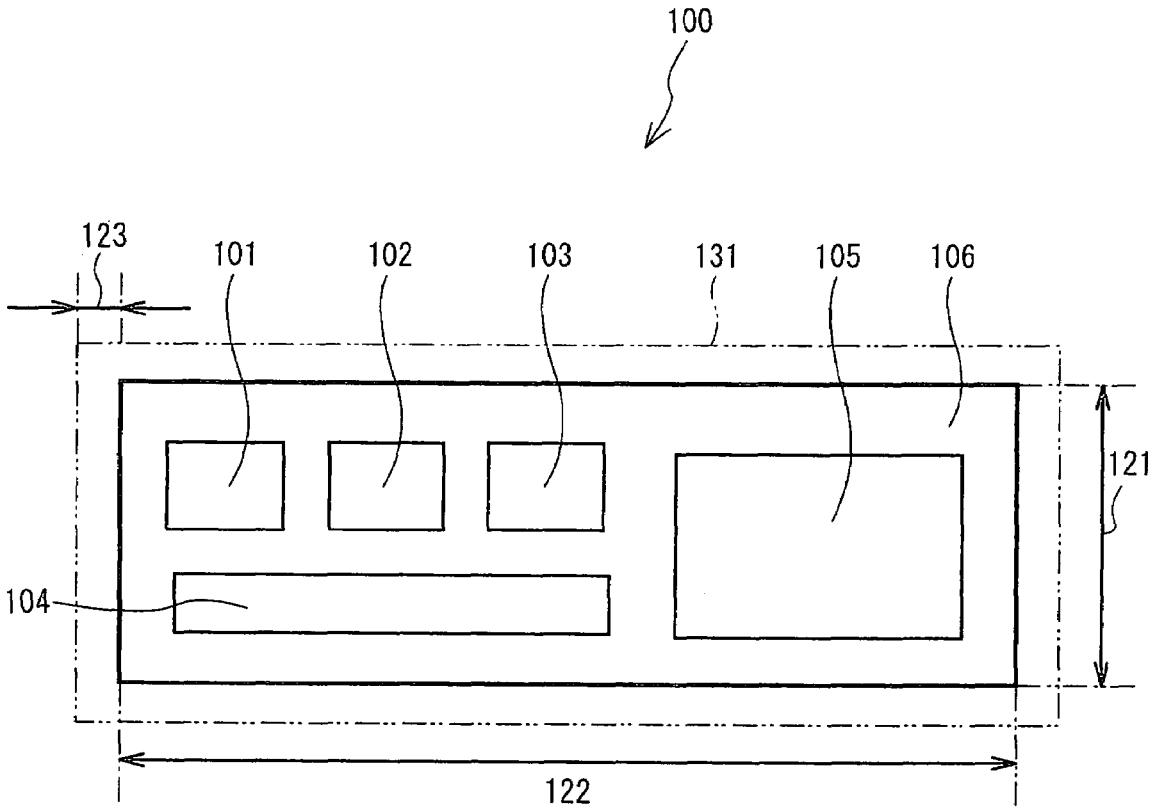
FIG. 4 is an explanatory diagram of an IC tag which is used in Example 1.

First, main processing which may be performed by the sewing machine 1 in one embodiment will be described below with reference to FIGS. 4 through 21. As Example 1, a case will be described below where an IC tag shown in FIG. 4 is covered by an embroidery pattern shown in FIGS. 5 and 6. First, an IC tag 100 and an embroidery pattern 200 of Example 1 will be described below with reference to FIGS. 4 though 7.

First, as one example of the IC tag, the IC tag 100 of Example 1 will be described below with reference to FIG. 4. The IC tag 100 has a configuration similar to that of the IC chip shown in FIG. 2 of Japanese unexamined patent publication No. Hei 11-15377. That is, as shown in FIG. 4, the IC tag 100 has a shape of a horizontally long rectangle that has a predetermined thickness, about 1 cm of the short side indicated by an arrow 121, and about 3 cm of the long side indicated by an arrow 122. In this example, the IC tag 100 further includes an information processing portion 101, a communication control portion 102, a power accumulation portion 103, an information storage portion 104, and an antenna 105, which may be covered by a member 106 made of a water-repellent material such as PET. The information processing portion 101 of the IC tag 100 generally will, in response to an instruction from an outside, operate the program stored in the information storage portion 104 to perform operations such as addition of the data. The communication control portion 102 may communicate data with the outside. The power accumulation portion 103 may temporarily accumulate power supplied from the outside, to supply power necessary for the operation of the information processing portion 101. The information storage portion 104 may store data used in the information processing portion 101 and data which is input from the outside. The antenna 105 may transmit and receive radio waves in communication with the outside and receive power supply from the outside. It should be noted that the IC tag of the present disclosure is not limited to Example 1 described above. An IC tag equipped with an information storage portion with various kinds of stored information can be employed. The size of the IC tag may be mostly dependent on a size of the antenna 105 which may be determined by a wavelength of communication radio waves and a communication-enabled distance. That is, the longer the wavelength of the communication radio waves are and the communication-enabled distance is, the larger the antenna 105 may become. Therefore, the size of the IC tag is not also limited to that described above.

Figure 5:
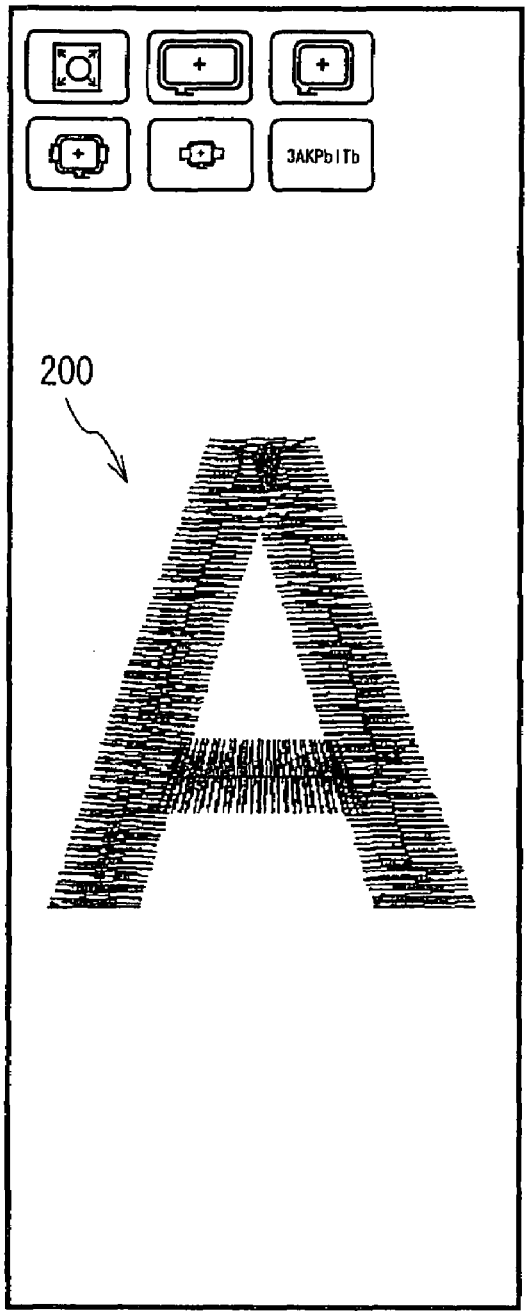
FIG. 5 is an explanatory diagram of a finish of an embroidery pattern of Example 1.
Figure 6:
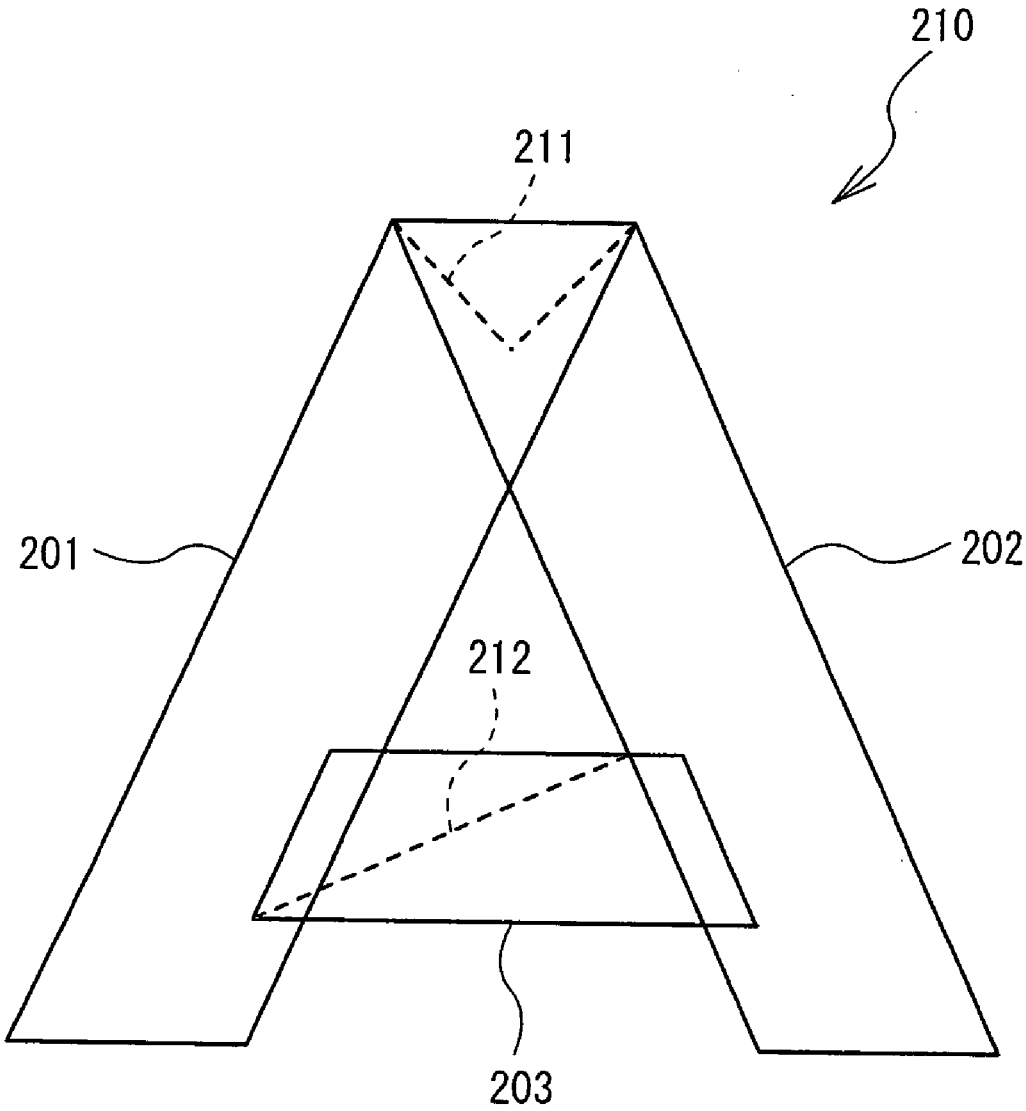
FIG. 6 is an explanatory diagram of the embroidery pattern of Example 1.
Figure 7:
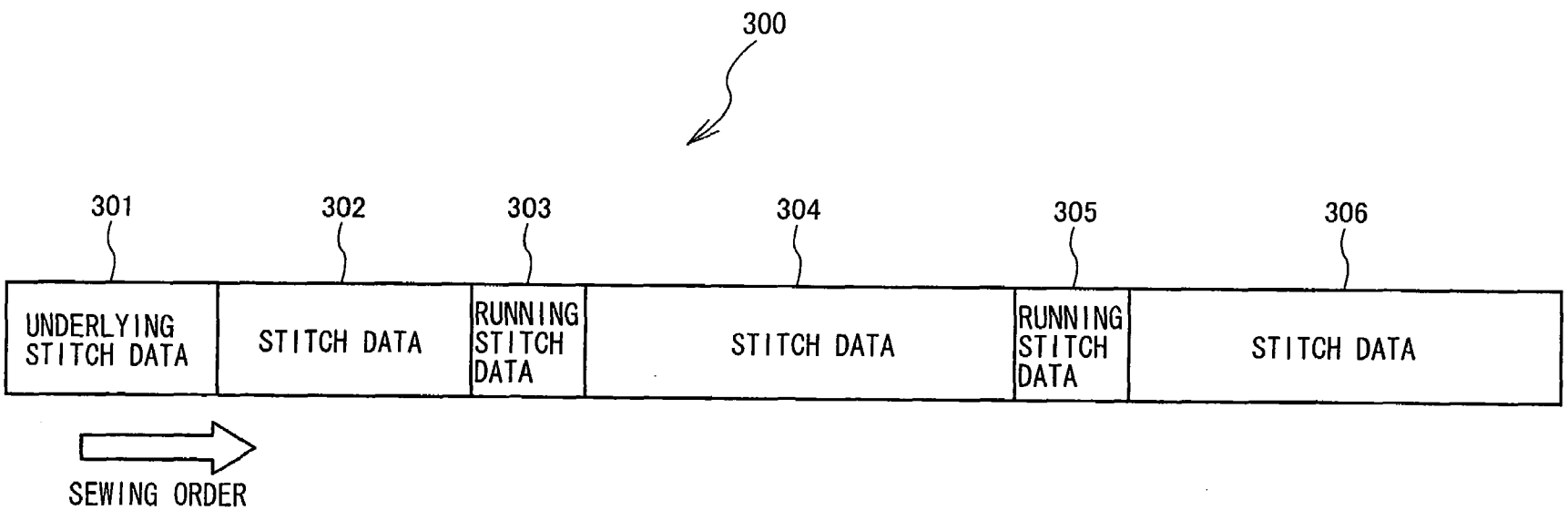
FIG. 7 is an explanatory diagram of embroidery data which is used to sew the embroidery pattern of Example 1.

Next, the embroidery pattern 200 according to Example 1 and embroidery data 300 used to embroider the embroidery pattern 200 will be described below with reference to FIGS. 5 through 7. As shown in FIG. 5, the embroidery pattern 200 represents a letter "A" of the alphabet in a size which enables the pattern to be located in an embroiderable area inside the inner periphery 35 of the embroidery frame 34. This embroidery pattern 200 may be formed by embedding partial embroidery areas 201 through 203 with stitches. The partial embroidery areas 201 through 203 may each be a closed area enclosed by visible outlines that define a shape of an embroidery area 210. As shown in FIG. 6, the partial embroidery areas 201 through 203 of the embroidery area 210 are comprised of the partial embroidery area 201 and 202 having a shape of a parallelogram and the partial embroidery area 203 which has a shape of a trapezoid. The partial embroidery areas are connected to each other with running stitch lines 211 and 212 which are present in the partial embroidery areas. Further, as shown in FIG. 7, the embroidery data 300 used to embroider the embroidery pattern 200 may include six embroidery segments of underlying stitch data 301, stitch data 302, running stitch data 303, stitch data 304, running stitch data 305, and stitch data 306 in order of embroidering. The underlying stitch data 301 may be used to prevent shrinkage of the work cloth to which the embroidery pattern 200 is embroidered and to perform underlying stitch so that a three-dimensional appearance is given to the embroidery pattern 200. The stitch data 302 may be used to form stitches in the partial embroidery area 201. The stitch data 303 may be used to form a running stitch line 211. The stitch data 304 may be used to form stitches in the partial embroidery area 202. The running stitch data 305 may be used to form a running stitch line 212. The stitch data 306 may be used to form stitches in the partial embroidery area 203. The embroidery data 300 may contain relative coordinates of an embroidery data which is referenced when the embroidery is positioned in an embroiderable area inside the inner periphery 35 of the embroidery frame 34. It should be noted that the underlying stitch data 301 can be omitted when underlying stitch is not performed.

Next, the main processing of the first embodiment for setting positions of an IC tag area and an embroidery area in an embroiderable area will be described with reference to FIGS. 8 through 21. In the first embodiment, whether the IC tag area can be positioned in an embroidery area which is based on embroidery data represented by relative coordinates of the positions set in the embroiderable area is determined. In the case, if having determined that an IC tag can be positioned in the embroidery area, it is determined that the embroidery area and the IC tag can be positioned in the embroiderable area. Then, the position of the IC tag area relative to the embroidery area is supposed to be set.

Figure 8:
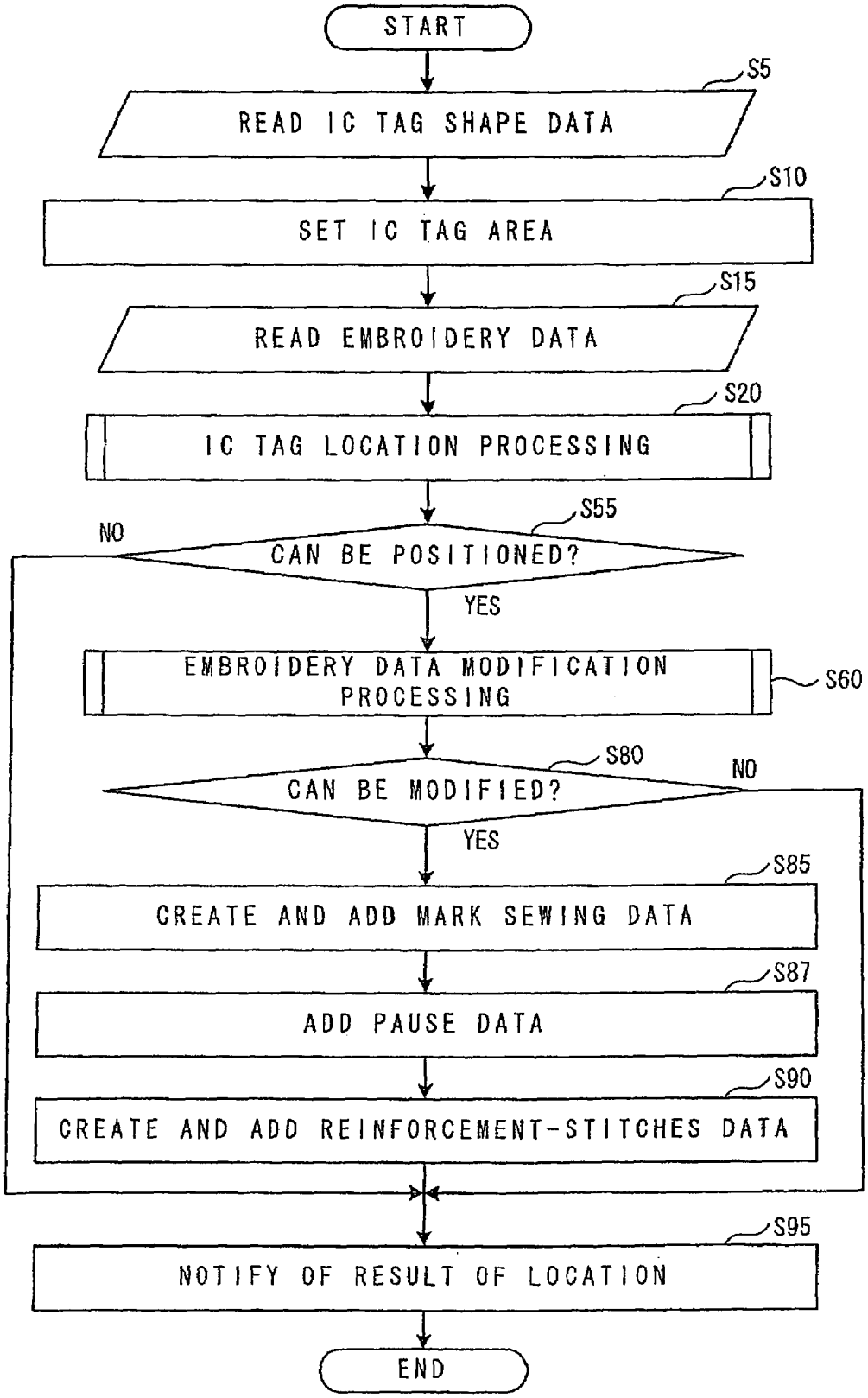
FIG. 8 is a flowchart illustrating a main processing of a first embodiment.
Figure 9:
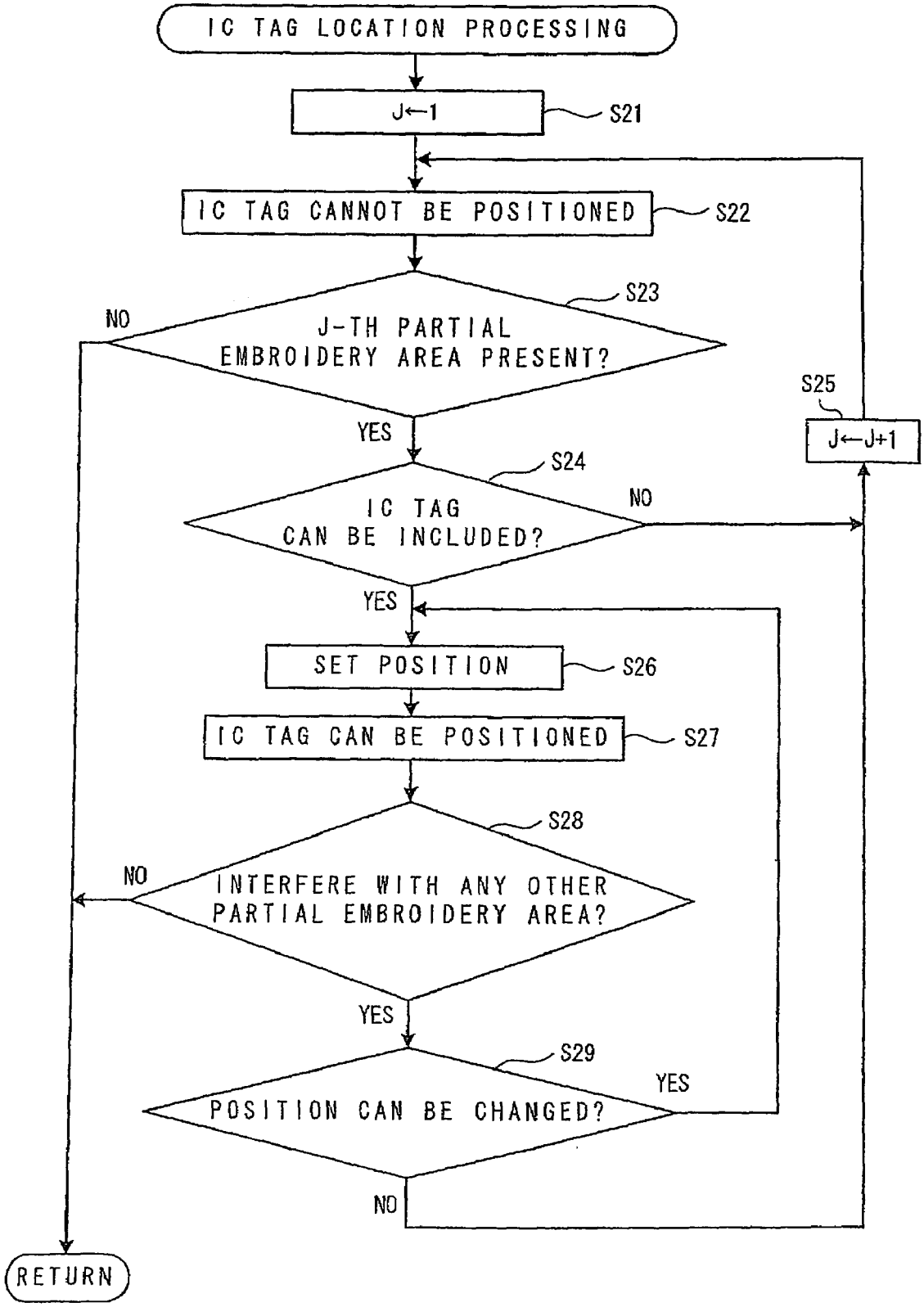
FIG. 9 is a flowchart illustrating an IC tag position processing which is performed in the main processing shown in FIG. 8.
Figure 11:
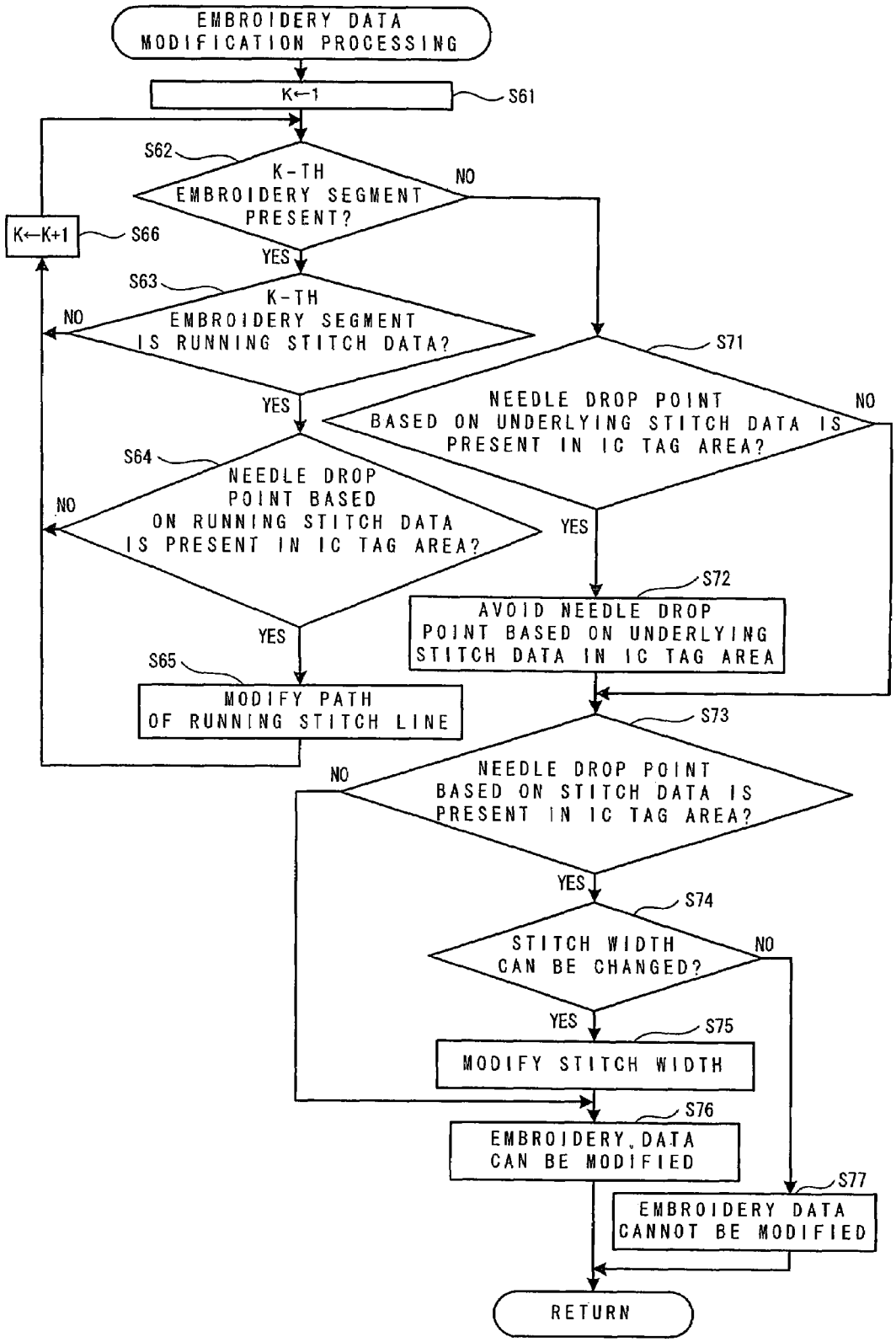
FIG. 11 is an explanatory flowchart of embroidery data modification processing which is performed in the main processing shown in FIG. 8.

A program that performs various pieces of processing shown in FIGS. 8, 9, and 11 may be stored in the ROM 62 beforehand and the CPU 61 shown in FIG. 2 may executed the processing illustrated therein. Further, various kinds of information used to perform various processing shown in FIGS. 8, 9, and 11 may be read from the ROM 62, the EEPROM 64, or the external storage device 39 and stored in a predetermined storage area in the RAM 63.

In the main processing shown in FIG. 8, first, the shape data of the IC tag 100 may be read and stored in the IC tag shape storage area 631 in the RAM 63 (S5). This processing may serve to determine an IC tag area based on a size and shape of the IC tag 100. For example, if the sewing machine 1 serving as the embroidery data processing apparatus is equipped with a scanner or a sensor for reading the shape of the IC tag 100, the shape of the IC tag 100 may be acquired by the scanner or sensor and read (S5). In the first embodiment, the image scanner sensor 27 may be used to acquire form information representing the size and shape of the IC tag 100 as the shape data, which may be stored in the IC tag shape storage area 631 in the RAM 63 (S5). In this case, a horizontally long rectangle as the shape of the IC tag 100 as well as the length of the short side indicated by the arrow 121 and a length of the long side indicated by the arrow 122 as the size of the IC tag 100 shown in FIG. 4 may be acquired. By thus acquiring the shape data through the image scanner sensor 27, the IC tag area can be determined appropriately which is used in processing to determine the positions of the embroidery area and the IC tag area in such a manner that the IC tag may be covered by an embroidery pattern.

Subsequently, the IC tag area may be set based on the shape data of the IC tag read at S5 and stored in the IC tag area storage area 632 in the RAM 63 (S10). By this processing, as shown in FIG. 4, an area of an outer periphery of a profile of the IC tag 100 plus a seam allowance indicated by an arrow 123 which is provided to sew the IC tag 100 to the work cloth may be set as an IC tag area 131, which may be stored in the IC tag area storage area 632 in the RAM 63 (S10). It should be noted that it is possible to arbitrarily set a width of the seam allowance to be added to the outer periphery of the profile of the IC tag 100. However, this seam allowance may be unnecessary in a case where the IC tag 100 is not sewn to the work cloth, for example.

Next, the embroidery data 300 which may be stored in the ROM 62 or a storage area such as the external storage device 39 may be read and stored in the embroidery data storage area 633 in the RAM 63 (S15). Subsequently, the IC tag location processing is performed to position the IC tag area in an embroidery area which is determined on the basis of the embroidery data 300 (S20). This IC tag location processing will be described below with reference to a flowchart shown in FIG. 9. It should be noted that an embroidery area may be determined on the basis of embroidery data. For example, if embroidery data contains so-called block data, closed areas determined on the basis of that block data may be combined to provide the embroidery area. Further, if embroidery data contains so-called one-stitch data, a profile of an embroidery pattern formed by one-stitch data may be obtained and the area within profile may provide the embroidery area.

An embroidery area based on embroidery data of the first embodiment may be subdivided into a plurality of partial embroidery areas as indicated in Example 1 of FIG. 6. Therefore, the partial embroidery areas may be read in the embroidering order, to determine whether an IC tag area can be included. Therefore, in the IC tag location processing shown in FIG. 9, first, "1" may be set to a partial embroidery area counter J, which may be used to read the partial embroidery areas in sequence, and may be stored in the partial embroidery area counter storage area 634 (S21). Subsequently, the IC tag location flag which may be used to determined whether the IC tag area can be positioned in the embroidery area is set to "0" indicating that the IC tag area cannot be positioned in the embroidery area. Then, the IC tag location flag may be stored in the IC tag location flag storage area 635 (S22). Subsequently, the embroidery data storage area 633 and the partial embroidery area counter storage area 634 may be referred to in order to determine whether there is a J-th partial embroidery area (S23). If having determined that there is no J-th partial embroidery area (NO at S23), it may be determined that all the partial embroidery areas have been read. Therefore, the IC tag position processing may end and the process may return to the main processing shown in FIG. 8.

On the other hand, in Example 1, as shown in FIG. 6, the embroidery area 210 may have the three partial embroidery areas 201 through 203. Further, as shown in FIG. 7, the embroidery data 300 of the embroidery pattern 200 may include the stitch data 302, 304, and 306 corresponding to those partial embroidery areas. Therefore, it may be determined that there is the first partial embroidery area 201 (YES at S23). Subsequently, the IC tag area storage area 632, the embroidery data storage area 633, and the partial embroidery area counter storage area 634 may be referred to in order to determine whether the IC tag area can be included in the J-th partial embroidery area (S24). In the processing of S24, relocation of the partial embroidery area and the IC tag area to relatively different positions may be repeated until a predetermined condition, such as checking all location combinations, is satisfied, and at each relocation, whether the IC tag area is included in the embroidery area may be determined. As a result, if having determined at least once that the IC tag area can be included, it may be determined that the IC tag area can be included in the partial embroidery area determined on the basis of the embroidery data. By thus making a determination, whether an IC tag area is included in an embroidery area can be determined reliably. It should be noted that this predetermined condition can be defined arbitrarily; for example, aside from the above-described condition in which all location combinations are checked, a condition may be set, in which the processing is ended if it is determined at least once that the IC tag area can be included.

Figure 10:
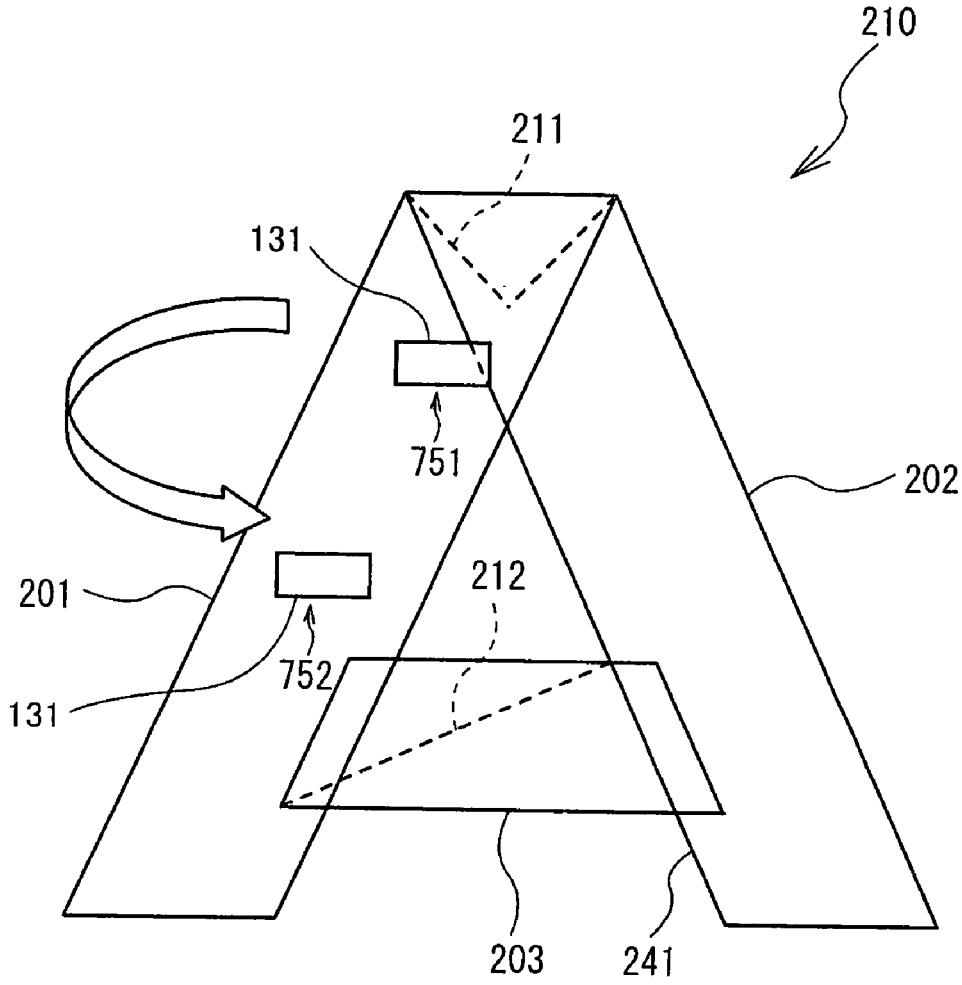
FIG. 10 is an explanatory illustration of an IC tag area whose position has been changed by the IC tag position processing shown in FIG. 9.

If having determined that the IC tag area cannot be included (NO at S24), to read the next partial embroidery area subsequently, the partial embroidery area counter J may be incremented by 1 and may be stored in the partial embroidery area counter storage area 634 (S25). Then, the processing may be repeated again from S22. On the other hand, in Example 1, as shown in FIG. 10, it may be determined that the IC tag area 131 can be included in the partial embroidery area 201 (YES at S24). Subsequently, the position of the IC tag area relative to the embroidery area 210 of the embroidery pattern 200 may be set as shown at an overlap area 751 of FIG. 10 and stored in the IC tag area location storage area 636 (S26). As described above, if having determined that the IC tag area can be positioned in the embroidery area, it is determined that the embroidery area and the IC tag area can be positioned in the embroiderable area. Therefore, in this processing, the position of the embroidery area 210 in the embroiderable area may be determined beforehand. Alternatively, the location of the embroidery area 210 in the embroiderable area may be determined by this processing. Further, only the location of the IC tag area 131 relative to the embroidery area 210 may be determined to determine the location of the embroidery area 210 in the embroiderable area in the subsequent processing such as sewing by use of the sewing machine 1 instead of determining the location of the embroidery area 210 in the embroiderable area. Further, the location only needs to be set in such an aspect that the position to which the IC tag area is located can be figured out. Therefore, for example, in a case of setting a position of the IC tag area by using an absolute position in an embroiderable area, coordinates representing an outline of the IC tag area or coordinates of a center of the IC tag area may be set. Further, when setting the position of the IC tag area relative to the position of the embroidery area, relative coordinates representing the outline of the IC tag area obtained from the predetermined point in the embroidery area or relative coordinates of the center of the IC tag area may be set.

Subsequently, the IC tag location flag may be set to "1", which indicates that the IC tag area can be located in the embroidery area, and may be stored in the IC tag location flag storage area 635 (S27). Subsequently, the embroidery data storage area 633 and the IC tag area location storage area 636 may be referred to in order to determine whether the IC tag area positioned at the position set at S26 interferes with any other partial embroidery area (S28). This processing may be performed by determining whether there is a turn-around point which is a needle drop point to change the sewing direction, among other needle drop points provided when stitches are formed in the partial embroidery area, within the overlap with area 751 where the partial embroidery areas 202 and 203 overlap the IC tag area 131 in Example 1, for example. If there is a turn-around point in the overlap area, the IC tag may be damaged or destroyed when the turn-around point is sewn. The turn-around point is one of needle drop points that make up a profile of an embroidery pattern, so that if a position of the turn-around point is modified or deleted, a design of the embroidery pattern may also changed. In contrast, in the first embodiment, in order to set a position of an IC tag area without changing a design of an embroidery pattern, the position of the IC tag area will be changed if it is determined that there is a turn-around point in an overlap area. Therefore, if having determined that there is no turn-around point in an overlap area (NO at S28), it may be determined that there is no need to re-set the position of the IC tag area once set at S26 and the process may return to the main process shown in FIG. 8.

On the other hand, it may be determined that there is a turn-around point on a side 241 of the partial embroidery pattern 202 in the overlap area 751 in Example 1 shown in FIG. 10 (YES at S28). Subsequently, whether the position of the IC tag area can be changed in the J-th partial embroidery area may be determined (S29). If having determined that the position of the IC tag area cannot be changed (NO at S29), to read the next partial embroidery area, the partial embroidery area counter J may be incremented by 1 and stored in the partial area embroidery counter storage area 634 (S25). Then, the processing may be repeated again from S22. To determine whether the position can be changed, it should be determined that the position cannot be changed if it is determined, for example, that a partial embroidery area determined to be capable of positioning the IC area therein interferes with other partial embroidery areas for all of obtained combinations of locations of the IC tag area with respect to that partial embroidery area.

On the other hand, if having determined that the position can be changed (YES at S29), the process may return to S26 to re-set an IC tag area (S26). In Example 1, on the assumption that the position of the IC tag area 131 shown in FIG. 10 is re-set to a location shown in an overlap area 752 (S26), whether the IC tag area at the position re-set at S26 following the process at S27 interferes with any other partial embroidery area may be determined (S28). In Example 1, the overlap area 752 shown in FIG. 10 has no area where it overlaps with the partial embroidery area 202 or 203, so that it is determined that there is no turn-around point in the IC tag area 131 (NO at S28). Subsequently, the IC tag location processing is ended and the process returns to the main processing of FIG. 8.

Following S20 of FIG. 8, the IC tag location flag storage area 635 maybe referred to in order to determine whether the IC tag area can be located in the embroidery area (S55). If the IC tag location flag is stored as being "0", it may be determined that the IC tag area cannot be positioned in the embroidery area (NO at S55) and an indication to the effect that the IC tag area cannot be positioned in the embroidery area is displayed on the LCD 15 (S95). By this processing, a user can confirm a result of the determination that the IC tag area cannot be positioned in the embroidery area. Then, the main processing may end.

On the other hand, if the IC tag location flag is stored as being "1" as in Example 1, it may be determined that the IC tag area can be positioned in the embroidery area 210 (YES at S55) and subsequently embroidery data modification processing may be performed (S60). The embroidery data modification processing will be described below with reference to a flowchart shown in FIG. 11. In the embroidery data modification processing of the first embodiment, first, processing to modify running stitch data may be performed along S62 through S66. Subsequently, processing to modify underlying stitch data may be performed along S71 and S72. Subsequently, processing to modify stitch data used to form stitches in a partial embroidery area may be performed along S73 through S75.

As shown in the flowchart of FIG. 11, first, "1" may be set to an embroidery segment counter K to read the embroidery segments contained in embroidery data in sequence and which may be stored in the embroidery segment counter storage area 637 (S61). Subsequently, whether there is a K-th embroidery segment may be determined (S62). This processing may be performed to read all the embroidery segments in sequence. As shown in FIG. 7, the embroidery data 300 of Example 1 may contain the six embroidery segments, so that it may be determined that there is the first embroidery segment (YES at S62). Subsequently, whether the K-th embroidery segment is running stitch data may be determined (S63). This processing may be performed to extract a case where the embroidery segment is running stitch data (YES at S63) and, if it is determined that a needle drop point based on that running stitch data is present in an IC tag area (YES at S64), a path of a running stitch line may be modified so that the needle drop point based on the running stitch data is not provided in the IC tag area (S65). In Example 1, the first embroidery segment is the underlying stitch data 301 (NO at S63), to read the next embroidery segment subsequently, the embroidery segment counter K may be incremented by 1 and may be stored in the embroidery segment counter storage area 637 (S66). Subsequently, the processing may be repeated again from S62.

Figure 12:
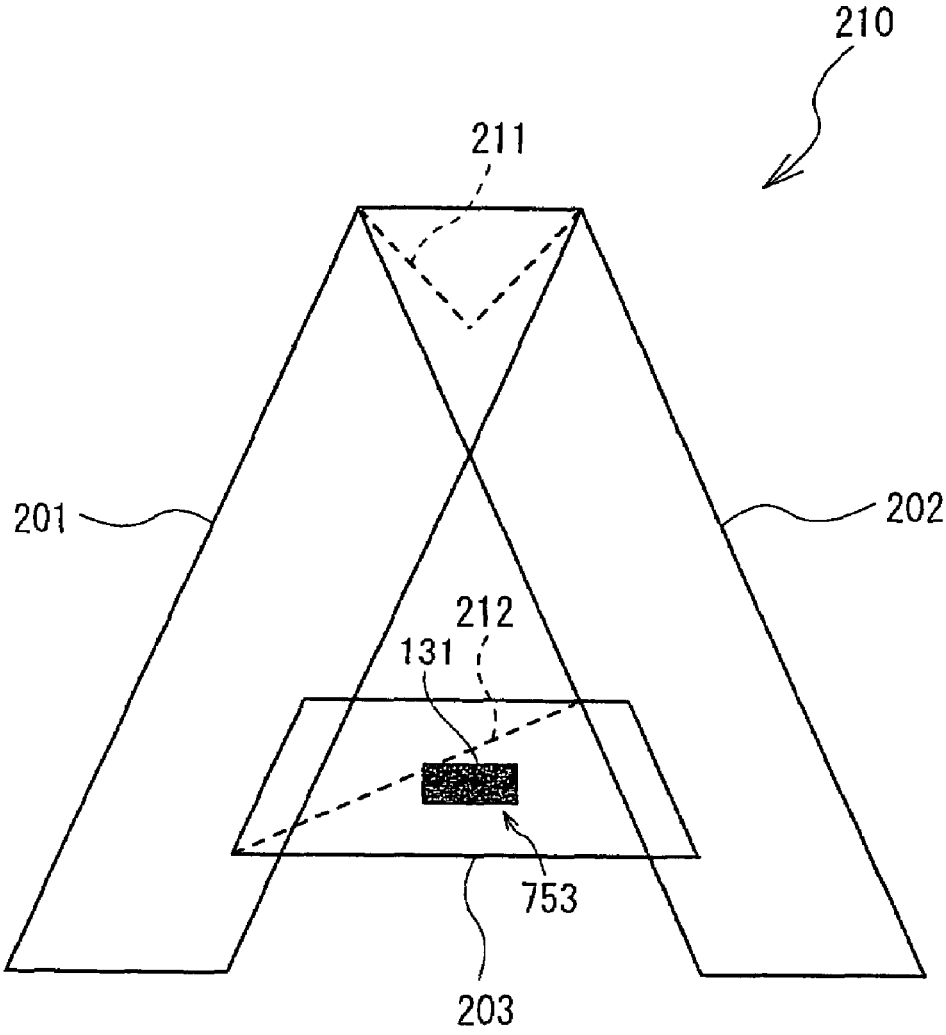
FIG. 12 is an explanatory diagram of a running stitch line 212 before a running path is modified in the embroidery data modification processing shown in FIG. 11.
Figure 13:
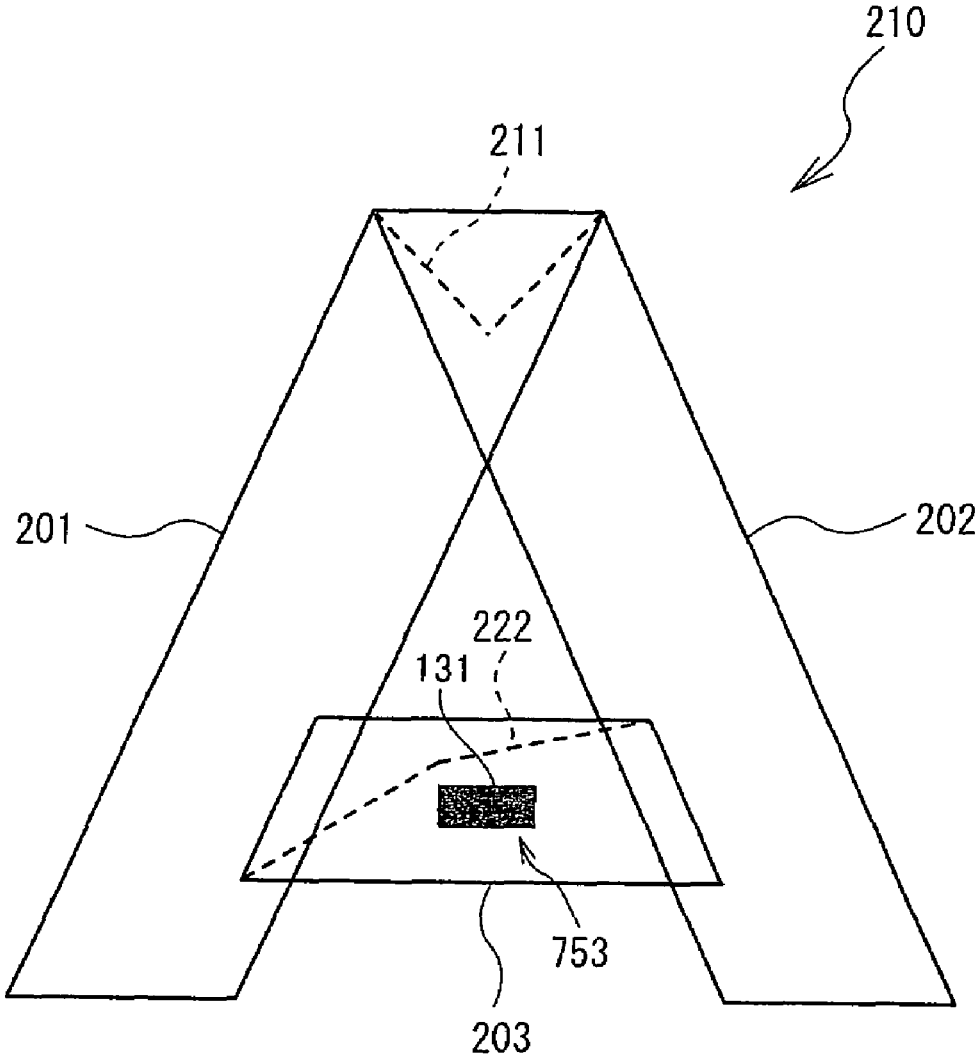
FIG. 13 is an explanatory diagram of the running stitch line 212 after the running path is modified in the embroidery data modification processing shown in FIG. 11.
Figure 14:
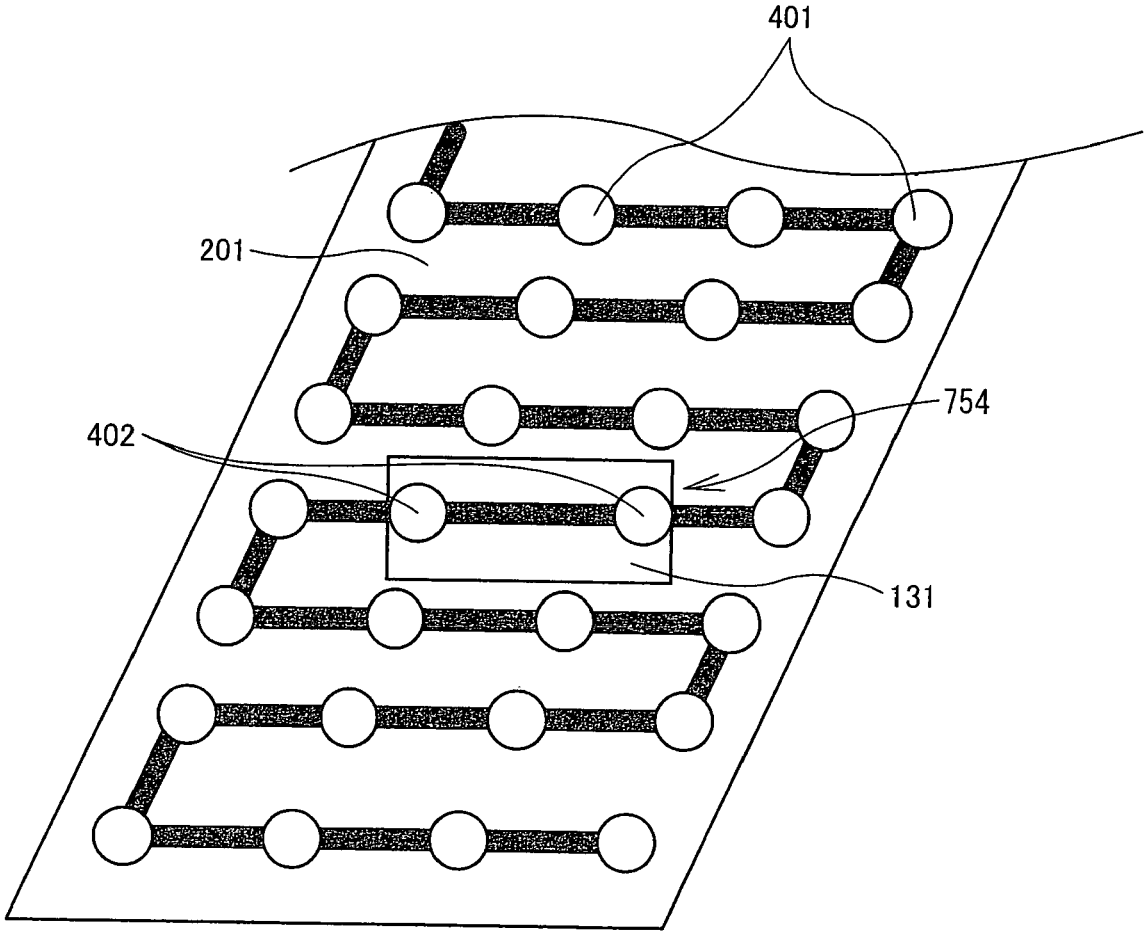
FIG. 14 is an explanatory diagram of a needle drop point of underlying stitch data before a modification is made by the embroidery data modification processing shown in FIG. 11.
Figure 15:
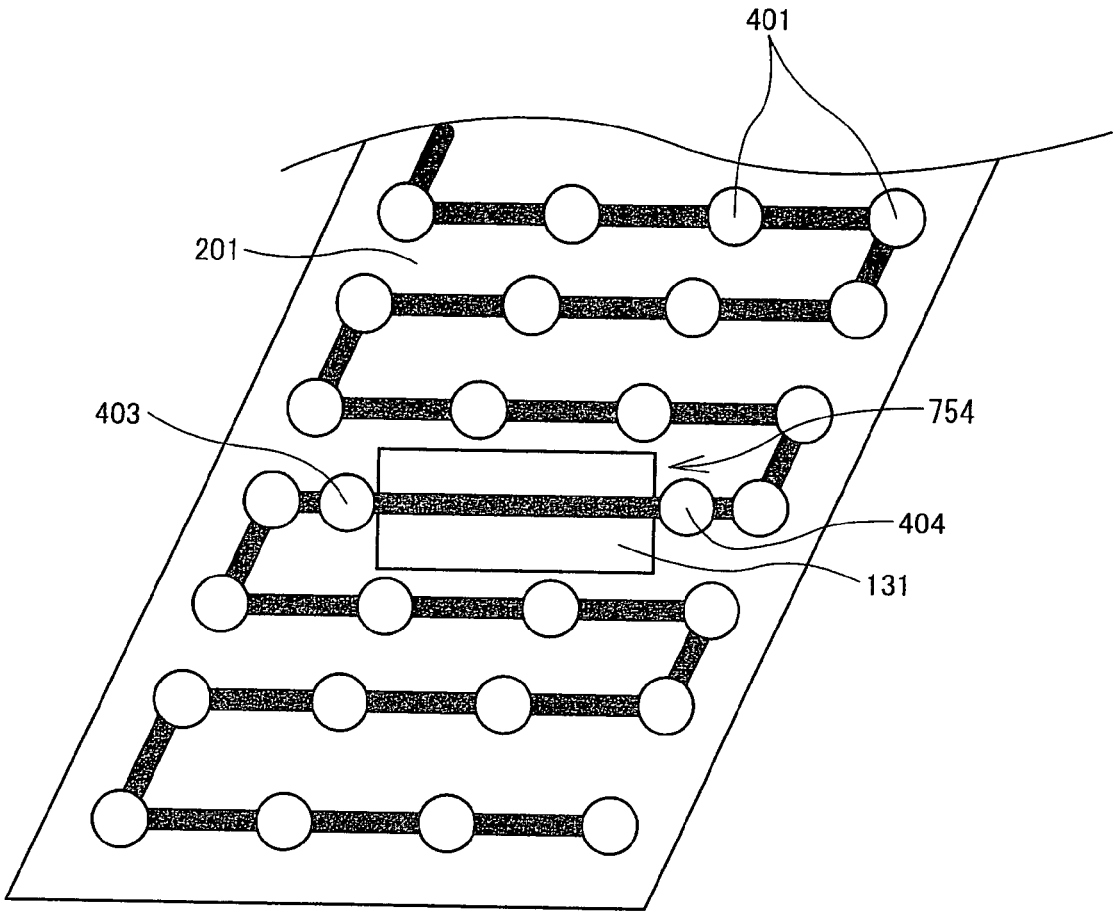
FIG. 15 is an explanatory diagram of a needle drop point of underlying stitch data after the position of the needle drop point is modified by the embroidery data modification processing shown in FIG. 11.

In Example 1, if K is set to 3 or 5 (S66) and the corresponding embroidery segment may be read through the same processing (S62), it may be determined that the third or fifth embroidery segment is running stitch data (YES at S63). Subsequently, whether a needle drop point based on the third or fifth running stitch data is present in the IC tag area may be determined (S64). If the IC tag area 131 is positioned as indicated by an overlap area 753 in the partial embroidery area 203 as shown in FIG. 12 at S20 of FIG. 8, it may be determined that the needle drop point based on the running stitch data 303, which is the third embroidery segment, is not determined in the IC tag area 131 at S64 (NO at S64). In this case, it may be determined that the running stitch data 303 needs not be modified and, to read the next embroidery segment, the embroidery segment counter K may be incremented by 1 and stored in the embroidery segment counter storage area 637 (S66). Subsequently, the processing may be repeated again from S62.

On the other hand, a needle drop point based on the running stitch data 305, which is the fifth embroidery segment, may be determined to be present in the positioned IC tag area 131 (YES at S64), as indicated by the overlap area 753. In this case, it may be determined that the running stitch data 305 needs to be modified. Subsequently, the running stitch data 305 may be modified so that the needle drop point based on the running stitch data is not provided in the IC tag area and may be stored in the embroidery data storage area 633 (S65). By this processing, the running stitch line 212 shown in FIG. 12 may be modified when the running stitch data 305 is modified so that the needle drop point based on the running stitch data is not provided in the IC tag area 131 and may be stored in the embroidery data storage area 633 (S65). Specifically, the running stitch line 212 may be modified so as to provide a running stitch line 222 shown in FIG. 13. The embroidery segment counter K may be incremented by 1 and stored in the embroidery segment counter storage area 637 (S66). Subsequently, the processing may be repeated again from S62.

If K is set to "7" by much the same processing (S66), it may be determined at the subsequent step of S62 that there is no seventh embroidery segment (NO at S62). Subsequently, the embroidery data storage area 633 and the IC tag area position storage area 636 may be referred to in order to determine whether a needle drop point based on underlying stitch data is present in the IC tag area (S71). If having determined that no needle drop point based on the underlying stitch data is present in the IC tag area (NO at S71), it may be determined that the underlying stitch data does not need to be modified. Subsequently, whether a needle drop point based on stitch data is present in an overlap area where the partial embroidery area and the IC tag area overlap may be determined (S73).

Figure 16:
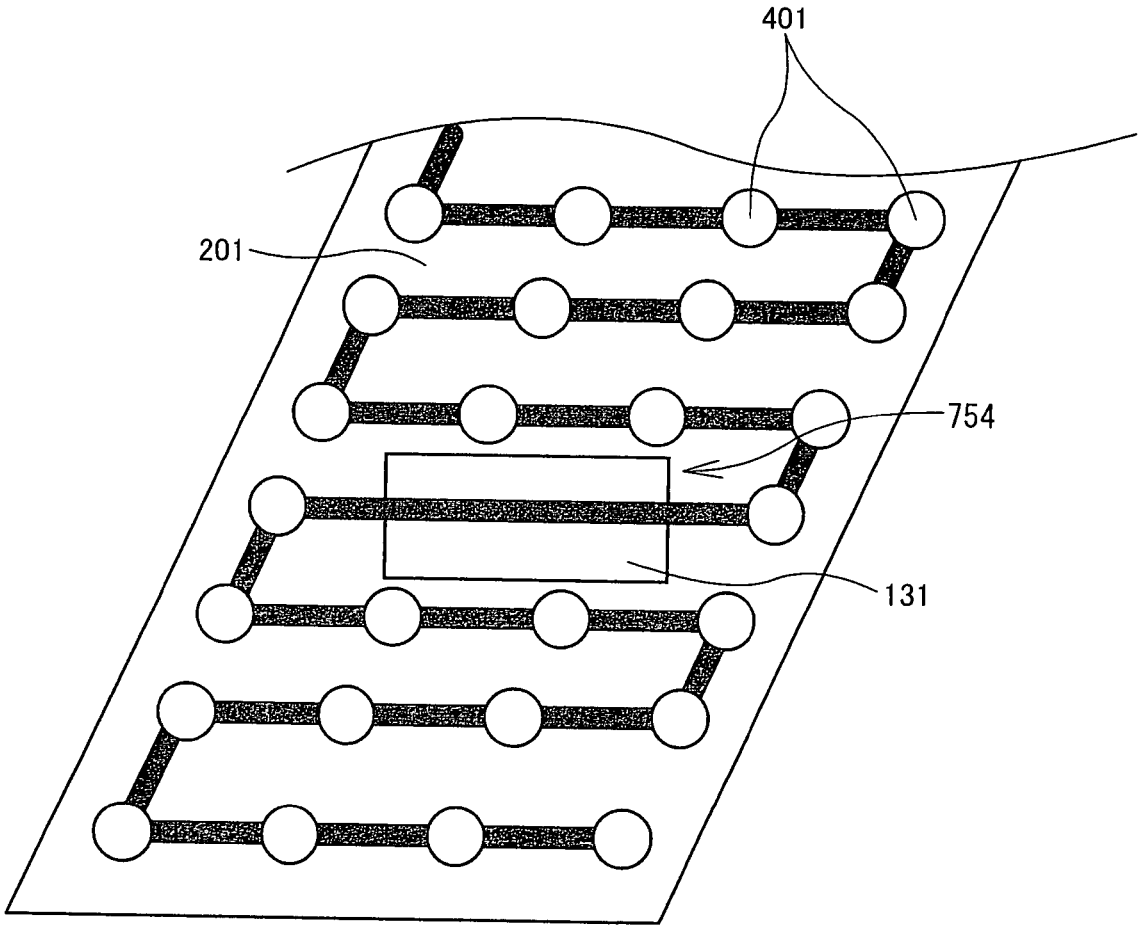
FIG. 16 is an explanatory diagram of a needle drop point of underlying stitch after the needle drop point is deleted from an IC tag area by the embroidery data modification processing shown in FIG. 11.

On the other hand, in Example 1, as shown in FIG. 7, the embroidery data 300 may contain the underlying stitch data 301 used to sew the underlying-stitches of embroidery area 210 of the embroidery pattern 200. Consequently, it is assumed to be determined that a needle drop point is present in an overlap area 754 where the partial embroidery area and the IC tag area 131 overlap with each other as in the case of a needle drop point 402 among needle drop points 401 based on the underlying stitch data indicated by white circles as shown schematically, for example, in FIG. 14 (YES at S71). In this case, the underlying stitch data may be modified so that no needle drop point based on the underlying stitch data is formed in the overlap area 754 and may be stored in the embroidery data storage area 633 (S72). In Example 1, the needle drop point 402 present in the overlap area 754 among the needle drop points 401 shown in FIG. 14 may be either moved out of the IC tag area like needle drop points 403 and 404 shown in FIG. 15 or deleted as shown in FIG. 16. This may cause the underlying stitch data to be modified so that no needle drop point based on the underlying stitch data is formed in the overlap area 754 and stored in the embroidery data storage area 633 (S72). As described above, underlying-stitch sewing may be carried out to prevent shrinkage by sewing of the work cloth to which an embroidery pattern is sewn and give a three-dimensional appearance to the embroidery pattern and so the underlying-stitch sewing does not have a large influence on the finish of the embroidery pattern when the needle drop point is moved or deleted within the embroidery area.

Subsequently, the embroidery data storage area 633 and the IC tag area location storage area 636 may be referred to in order to determine whether a needle drop point based on stitch data used to form stitches in the partial embroidery area is present in an overlap area where the partial embroidery area and the IC tag area overlap (S73). If having determined that there is no needle drop point based on the stitch data therein (NO at S73), it may be determined that the stitch data need not be modified. Subsequently, an embroidery data modification flag which may be used to determine whether embroidery data can be modified may be set to "1", which indicates that the data can be modified, and may be stored in the embroidery data modification flag storage area 638 (S76). Subsequently, the embroidery data modification processing may end and the process may return to the main processing shown in FIG. 8. On the other hand, in Example 1, it may be assumed to be determined that a needle drop point is present in the overlap area 754 where the partial embroidery area and the IC tag area 131 overlap with each other as in the case of a needle drop point 452 out of needle drop points 451 based on the stitch data indicated by white circles as shown schematically, for example, in FIG. 17 (YES at S73). In this case, whether a stitch width can be modified may be determined so that the needle drop point based on the stitch data is not formed in the overlap area (S74). This processing may be performed to confirm that modification involving a change in stitch width can be performed because modification of the needle drop point based on the stitch data may have an influence on the finish of embroidery. In this processing, whether the stitch width can be changed may be set beforehand and stored in the ROM 62 or the EEPROM 64. Otherwise, the user may specify the setting through the touch panel 26. If having determined at S74 that the stitch width cannot be changed (NO at S74), the embroidery data modification flag may be set to "0", which indicates that the embroidery data cannot be modified, and may be stored in the embroidery data modification flag storage area 638 (S77). Subsequently, the embroidery data modification processing may end and the process may return to the main processing shown in FIG. 8.

Figure 17:
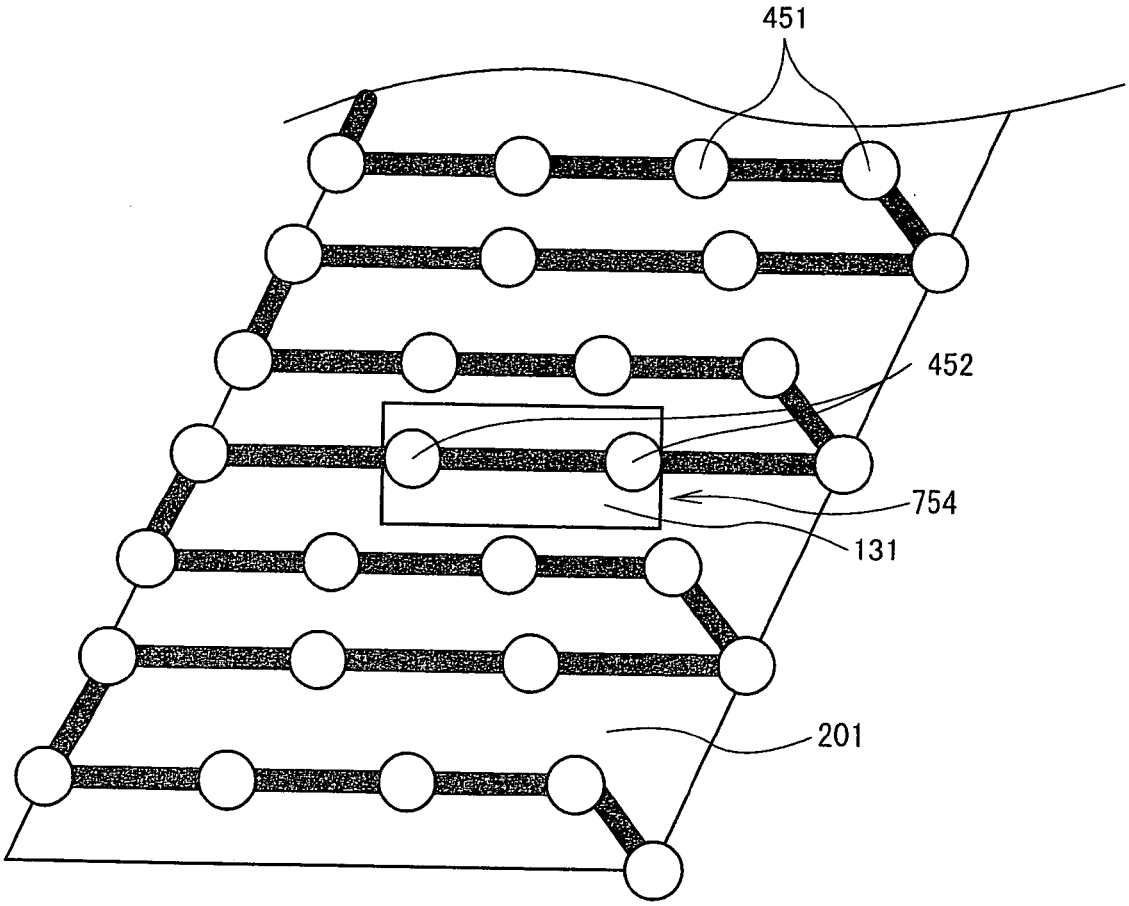
FIG. 17 is an explanatory diagram of a needle drop point stitch data before a modification is made in the embroidery data modification processing shown in FIG. 11.
Figure 18:
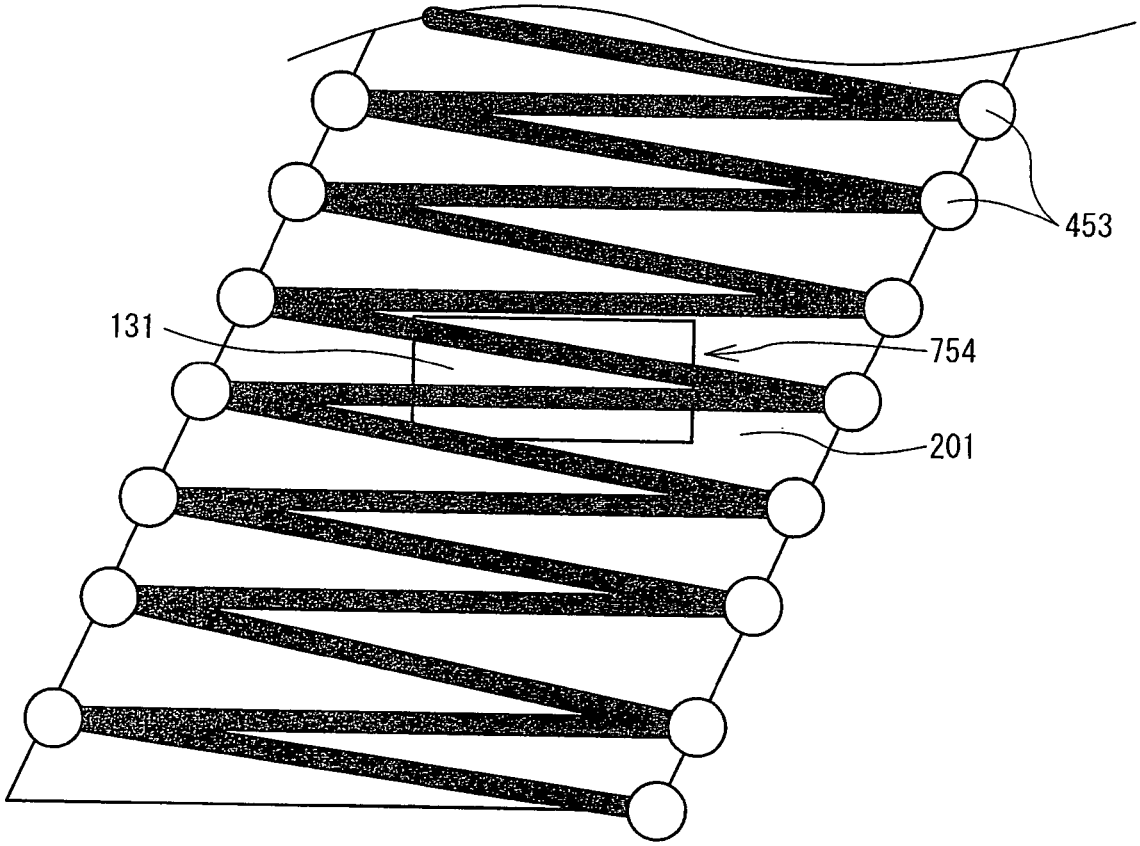
FIG. 18 is an explanatory diagram of a needle drop point of stitch data after the position of the needle drop point is modified by the embroidery data modification processing shown in FIG. 11.
Figure 19:
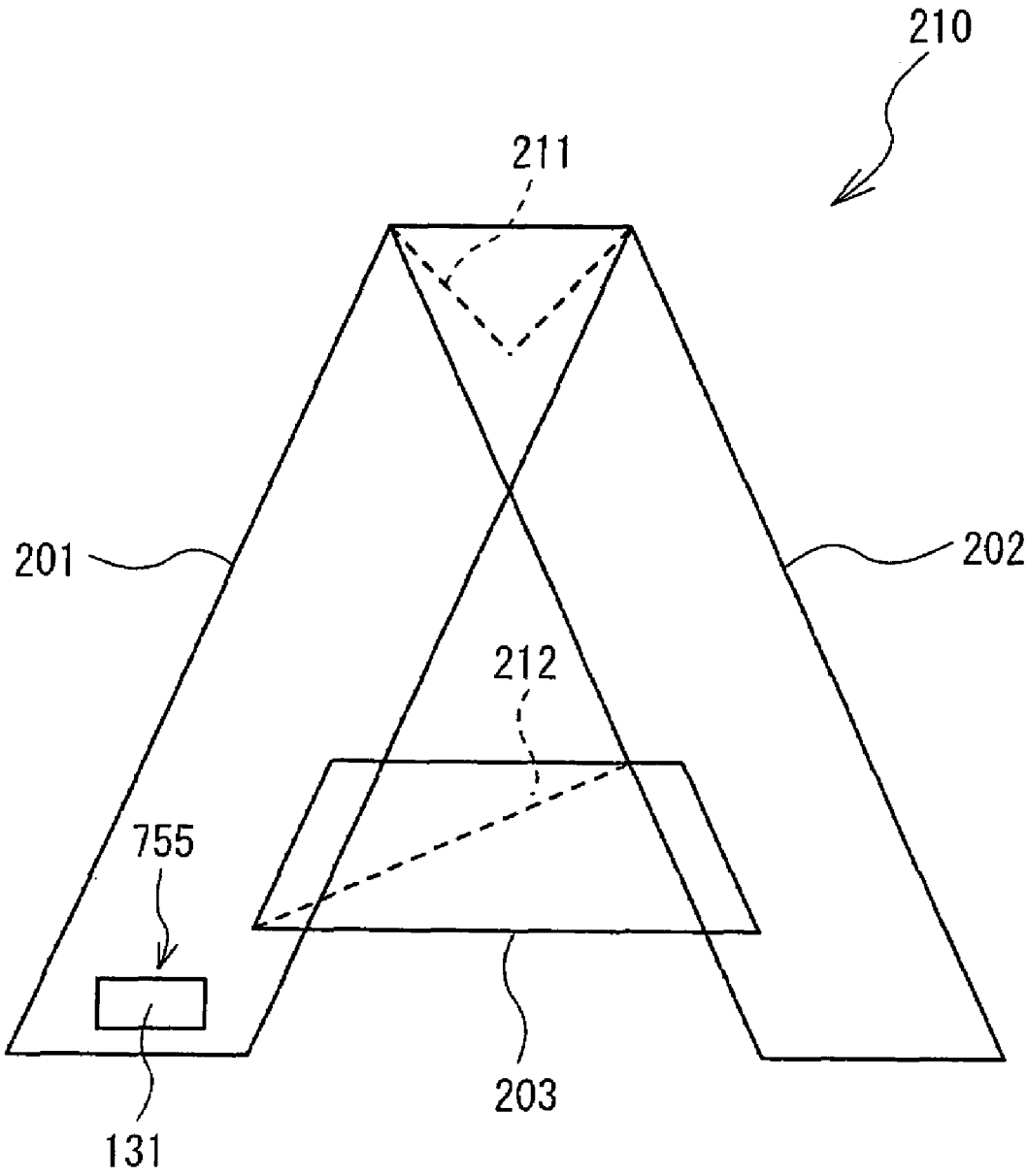
FIG. 19 is an explanatory diagram of a position of an IC tag area which is set by the main processing shown in FIG. 8.

On the other hand, in Example 1, it may be supposed that the stitch width is changed in the EEPROM 64 starting from tatami stitch which forms stitches having a predetermined stitch width in the partial embroidery area as shown in FIG. 17, to change the sewing mode to satin stitch which provides needle drop points only on a profile line of the partial embroidery area as shown in FIG. 18. In this case, the EEPROM 64 may be referred to in order to determine that the stitch width can be changed (YES at S74). Subsequently, in accordance with an instruction stored in the EEPROM 64, the stitch width may be changed so that needle drop points 453 may be provided only on the profile line of the partial embroidery area as shown in FIG. 18 and may be stored in the embroidery data storage area 633 (S75). As in Example 1, a method for changing the stitch width may be specified beforehand or a minimum stitch width that can be employed to perform sewing in such a manner as to provide no needle drop point in the IC tag area may be calculated and applied. Further, since a change in stitch width of a needle drop point based on stitch data may have an influence on the finish of an embroidery pattern, rather than changing the stitch width over the embroidery area partially, the stitch width over an entirety of the embroidery area may preferably be changed. Subsequently, the embroidery data modification flag may be set to "1" and may be stored in the embroidery data modification flag storage area 638 (S76). Subsequently, the embroidery data modification processing may end and the process may return to the main processing shown in FIG. 8.

Following S60 of FIG. 8, the embroidery data modification flag storage area 638 may be referred to in order to determine whether embroidery data can be modified (S80). If the embroidery data modification flag may be stored as being "0" (NO at S80), which means that the embroidery data cannot be modified, it may be determined that the IC tag area cannot be positioned in the embroidery area and an indication to the effect that the IC tag area cannot be positioned in the embroidery area may be given (S95). Through this processing, the user can confirm the result of the determination that the IC tag area cannot be positioned in the embroidery area. Then, the main processing may end. It should be noted that even when the embroidery data cannot be modified, the process may be returned to S20 following S80 (No at S80) in order to determine whether an IC tag can be relocated to a position where the embroidery data can be modified.

Figure 20:
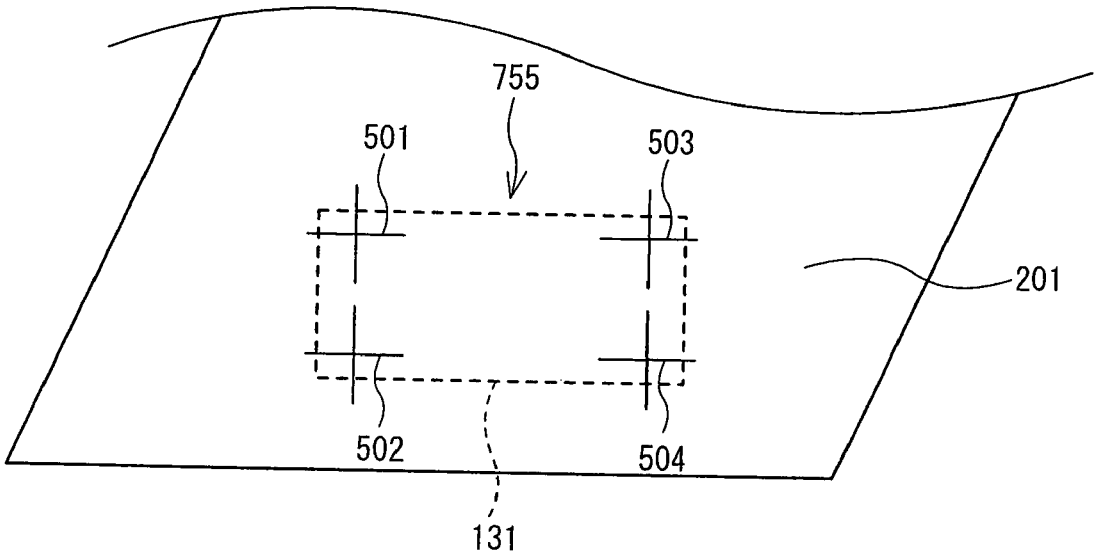
FIG. 20 is an explanatory diagram of mark sewing data used to form stitches that serve as an eyemark which is used when positioning an IC tag on a work cloth.

On the other hand, in a case where the embroidery data modification flag is stored as being "1" (YES at S80) as in the case of Example 1, it may be determined that the IC tag area can be positioned in the embroidery area. Subsequently, mark sewing data used to form stitches that serve as a mark when positioning an IC tag to a work cloth may be created and added to the embroidery data (S85). This mark sewing data only needs to serve as a mark when positioning the IC tag and so may be, for example, sewing data used to form stitches that match a profile of the IC tag or sewing data used to form stitches that indicate a center of the IC tag. In Example 1, if the IC tag area 131 is set to a position indicated in an overlap area 755 of FIG. 19 at S20, as the mark sewing data, as shown in FIG. 20, for example, sewing data used to form stitches 501 through 504 on cross-shapes having intersection points inside a profile line of the IC tag area 131 may be created. The intersection points of the cross-shapes of the stitches 501 through 504 may indicate positions where vertexes of the IC tag 100 are positioned respectively. This mark sewing data may be added to a position immediately preceding the underlying stitch data 301, which is the first embroidery segment shown in FIG. 7, and may be stored in the embroidery data storage area 633 (S85). By creating and adding the mark sewing data, it is possible to easily position the IC tag to a set position by using as a mark the stitches formed on the work cloth based on the mark sewing data.

Subsequently, pause data may be added following the mark sewing data added to the embroidery data at S85 (S87). This process may be performed to insert data which is used to pause the sewing operation by the sewing machine 1 in order to position the IC tag while having stitches as a mark after the stitches are formed by the mark sewing data. In Example 1, the pause data is inserted between the mark sewing data and the underlying stitch data 301, and stored in the embroidery data storage area 633 (S87).

Figure 21:
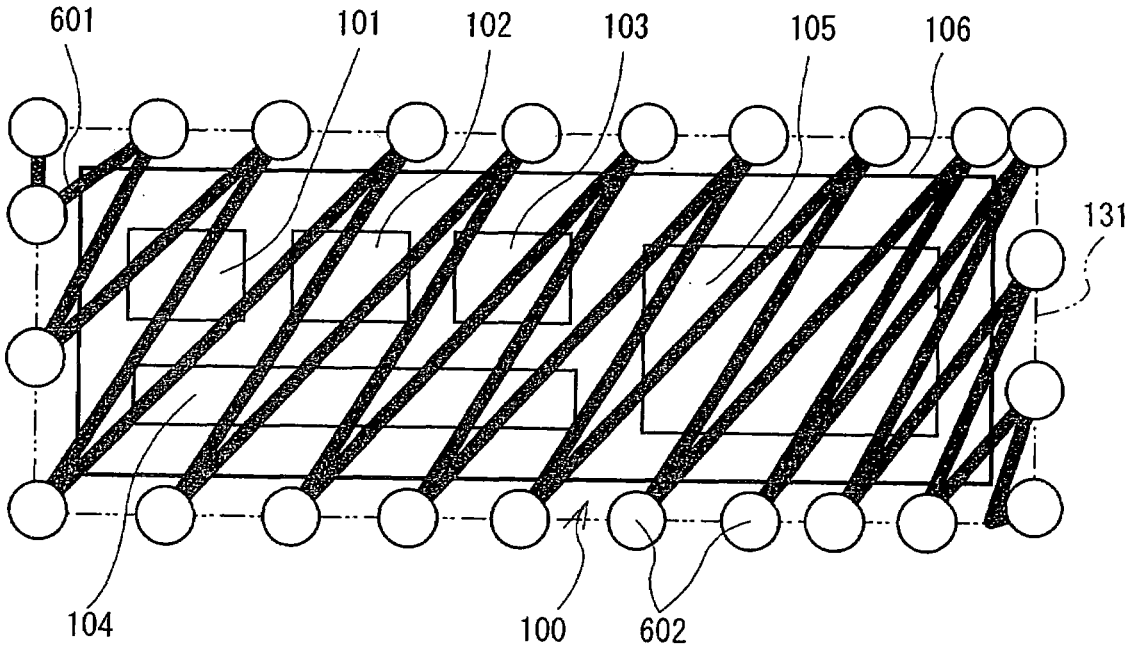
FIG. 21 is an explanatory diagram of reinforcement-stitches data used to form stitches to fix an IC tag to a work cloth.

Subsequently, reinforcement-stitches data used to sew the IC tag to the work cloth may be created and added to the embroidery data (S90). Any stitches can be employed arbitrarily as far as they serve to sew the IC tag to the work cloth. In Example 1, as the reinforcement-stitches data, embroidery data is created which has needle drop points on each of the profile line of the IC tag area 131 such as needle drop points 602, which are indicated by white circles in the figure, used to sew the IC tag 100 to the work cloth, as shown in FIG. 21. By thus transferring a thread 601 interconnecting the needle drop points 602 obliquely with respect to the IC tag 100 so that the IC tag 100 may be covered with the thread 601 from every direction, the IC tag 100 can be sewn securely to the work cloth. The thus created reinforcement-stitches data may be added between pause data added at S87 and the underlying stitch data 301 and may be stored in the embroidery data storage area 633 (S90). Subsequently, the positions where the IC tag area and the embroidery area are positioned may be displayed on the LCD 15 (S95). The user can confirm the positions indicated on the LCD 15 and, in accordance with these positions, position the IC tag to the work cloth. Then, the main processing shown in FIG. 8 is ended.

According to the sewing machine 1 equipped with the embroidery data processing apparatus of the first embodiment described in detail above, it is possible to determine the positions of the embroidery area and the IC tag area so that the IC tag area attached to the work cloth may be included in an embroidery area. Therefore, in accordance with the positions of the embroidery area and the IC tag area determined by the embroidery data processing apparatus of the first embodiment, the IC tag attached to the work cloth with an embroidery pattern and the IC tag capable of retaining a lot of information can be attached to the work cloth without damaging the design of the work cloth.

Further, relocation of an embroidery area and an IC tag area positioned in an embroiderable area at S24 shown in FIG. 9 to relatively different positions may be repeated until predetermined conditions are satisfied. Upon each relocation, whether the IC tag area is included in the embroidery area may be determined. If having determined at least once that the IC tag can be included, it may be determined that the IC tag area can be included in the embroidery area determined on the basis of the embroidery data. It is thus possible to securely determine whether the IC tag area is included in the embroidery area.

Further, the image scanner sensor 27 may acquire, as outline data, form information that represents the size and a shape of an IC tag to be attached to the work cloth, and the IC tag area can be determined based on the outline data. Therefore, the IC tag area which is used in processing to determine positions of the embroidery area and the IC tag area can be appropriately determined so that the IC tag can be covered by the embroidery pattern.

Further, if there is a turn-around point, which is a needle drop point where the sewing direction changes, in an overlap area of an embroidery area which overlaps with an IC tag area (YES at S28), it is possible to re-set the positions of the IC tag area and the embroidery area so that there is no turn-around point in the overlap area (YES at S29, S26). Further, if there is no turn-around point in an overlap area of an embroidery area which overlaps with an IC tag area, even if there are needle drop points in the overlap area, the embroidery data can be modified so that no needle drop point is in the overlap area (S65, S72, S75 of FIG. 11). Therefore, an IC tag can be positioned on a work cloth in accordance with positions of an embroidery area and an IC tag area determined by the embroidery data processing apparatus of the present disclosure, to sew embroidery by using embroidery data modified by the embroidery data processing apparatus of the present disclosure, thereby covering the IC tag attached on the work cloth with the embroidery pattern without damaging or destroying the IC tag with a sewing needle during sewing the embroidery. Further, if there are needle drop points based on stitch data in an overlap area of an embroidery area which overlaps with an IC tag area (YES at S73), embroidery data can be modified by changing a stitch width of an embroidery pattern so that no needle drop point is in the overlap area. It is thus possible to modify the embroidery data while without substantially altering the finish of the embroidery.

Further, mark sewing data which may be used to form the stitches 501 through 504 that may serve as a mark when positioning the IC tag 100 to the work cloth may be added to a position preceding the embroidery data. Further, pause data may be inserted between the mark sewing data and the embroidery data. It is thus possible to sew the stitches 501 through 504 that serve as a mark when positioning the IC tag 100 to work cloth based on mark sewing data determined by the embroidery data processing apparatus of the present disclosure to stop the sewing operation by the sewing machine 1 based on pause data. Therefore, it is possible to appropriately position an IC tag on work cloth by using the stitches 501 through 504 as a mark when the sewing machine is at stop and then to resume the sewing operation by the sewing machine 1 so that an embroidery pattern based on embroidery data can be sewn. It is also possible to create reinforcement-stitches data used to form stitches with which to sew the IC tag to the work cloth positioned at an appropriate position by using as a mark the stitches 501 through 504 formed on the basis of mark sewing data. The IC tag can thus be fixed securely on the work cloth.

The sewing machine 1 equipped with the embroidery data processing apparatus of the first embodiment may further include the LCD 15 to indicate a result of determination, which may be made when an embroidery pattern area has no area to include an IC tag area, and to indicate the positions of the embroidery area and the IC tag area. Therefore, if the result of the determination, which may be made when the embroidery area has no area to include the IC tag area, is indicated on the LCD 15, the user can know whether any area is available in which the IC tag area may be included. Further, if the positions to which the embroidery area and the IC tag area are positioned are indicated on the LCD 15, the IC tag can be positioned on the work cloth in accordance with the indicated positions so that the IC tag may be covered with the embroidery pattern.

It should be noted that the present disclosure is not limited to the first embodiment described in detail above and can be changed in a variety of manners without departing from the spirit and scope of this disclosure, as characterized in the appended claims.

First, although the first embodiment has been described with reference to the case where the embroidery data processing apparatus has been integrated with the sewing machine 1, it is not limited to this aspect and the embroidery data processing apparatus may be separated from the sewing machine 1. Further, although the first embodiment has been described with reference to the case where the present disclosure has been applied to the sewing machine 1 that can sew embroidery by using one needle bar, the present disclosure may be applied to a multi-needle type sewing machine that is equipped with a plurality of needle bars.

First, although in the first embodiment the inside of the inner periphery 35 of the embroidery frame 34 may be set as an embroiderable area, the present disclosure is not limited to that; the embroiderable area may be a predetermined portion of the inside of the inner periphery 35 of the embroidery frame 34 or an area outside the embroidery frame 34.

Further, in the first embodiment, at S5 of FIG. 8, shape data may be acquired through the image scanner sensor 27 as form information that may represent the size and shape of the IC tag 100 and may be stored in the IC tag shape storage area 631 in the RAM 63 (S5). However, acquiring the IC tag form information is not limited to this method. For example, in a case where shape data of the IC tag 100 is stored beforehand in such as the ROM 62 or the external storage device 39, the storage areas may be referred to at S5 to read the shape data of the IC tag 100 and may be stored in the IC tag shape storage area 631 in the RAM 63 (S5). Further, in a case where an IC tag area is determined on the basis of the shape data of the IC tag is stored beforehand in such as the ROM 62 or the external storage device 39, the storage areas may be referred to at S5 to read the IC tag area for the IC tag 100 and may be stored in the IC tag area storage area 632 in the RAM 63 (S5), thus not requiring the subsequent processing of S10. Further, for example, if the shape data of the IC tag is stored together with a predetermined ID in such as the ROM 62 or the external storage device 39 and the ID is specified by the user, the storage areas may be referred to in order to read shape data of the IC tag 100 corresponding to the specified ID and may be stored in the IC tag shape storage area 631 in the RAM 63 (S5). It should be noted that instead of being stored beforehand in such as the ROM 62 or the external storage device 39, the shape data, the IC tag area, and the ID of the IC tag 100 may be determined by configuring the sewing machine 1 to enable a connection with a network such as the Internet.

Further, for example, if a shape of an IC tag is entered through the touch panel 26, the entered shape data may be read and stored in the IC tag shape storage area 631 in the RAM 63 (S5). It should be noted that the touch panel 26 may be replaced by any one of various switches, a trackball, or a joystick on a game controller that interfaces with the user.

The configuration of embroidery data of the present disclosure is not limited to that of Example 1 exemplified to describe the first embodiment; the present disclosure can be applied to embroidery data having an arbitrary configuration. For example, although in Example 1 the underlying stitch data 301 is contained in the embroidery data 300, the embroidery data does not have to contain the underlying stitch data if underlying stitch sewing is not performed. Further, although in Example 1 the embroidery data contains stitch data pieces that correspond to a plurality of partial embroidery areas, the embroidery data may be comprised of stitch data that corresponds to one embroidery area. In this case, an embroidery area may be set on the basis of a profile of an embroidery area obtained from the stitch data, to determine whether an IC tag can be included in the embroidery area in the IC tag position processing shown in FIG. 9 and it may be determined whether there is any turn-around point based on the stitch data in a positioned IC tag area at S28 of FIG. 9.

Further, in the first embodiment, in the case of performing underlying stitch sewing based on embroidery data, it has been assumed to perform underlying stitch sewing on a work cloth on which an IC tag is positioned. However, the present disclosure is not limited to that; the IC tag may be positioned to work cloth after underlying stitch sewing is performed. In this case, the processing of S71 and S72 shown in FIG. 11 can be omitted because the IC tag cannot be damaged or destroyed by a sewing needle at a needle drop point based on underlying stitch data. Further, in this case, mark sewing data created at S85 of FIG. 8 may be added immediately following the underlying stitch data 301 and may be stored in the embroidery data storage area 633 (S85), pause data may be inserted between the mark sewing data and the stitch data 302 and may be stored in the embroidery data storage area 633 at S87 of FIG. 8 (S87), and reinforcement-stitches data created at S90 may be added between the pause data created at S87 and the stitch data 302 and may be stored in the embroidery data storage area 633 (S90).

Further, in the first embodiment, if it is determined that there is a turn-around point in an IC tag area at S28 in FIG. 9 (NO at S28), the IC tag area may be relocated. However, in a case where it is permitted to change a position of a turn-around point, that is, it is permitted to change a design of an embroidery pattern, this processing may be omitted to modify the position of the turn-around point. Further, if it is permitted to change a size of an embroidery pattern, embroidery data may be modified to change the size of the embroidery pattern so that no turn-around point is in the IC tag area.

Further, in the first embodiment, mark sewing data used to form stitches that serve as a mark when positioning an IC tag on a work cloth may be created and added to embroidery data at S85. However, for example, this processing may be omitted if such stitches need not be formed when positioning the IC tag on the work cloth based on the position notified at S95.

Further, in the first embodiment, reinforcement-stitches data used to sew an IC tag to a work cloth may be created and added to embroidery data at S90. However, for example, this processing may be omitted if the IC tag need not be sewn to the work cloth if, for example, the IC tag is fixed to the work cloth with an adhesive or pressure-sensitive adhesive agent.

Further, in the first embodiment, if having determined that it is impossible to position the IC tag in an embroidery area (NO at S55 or NO at S80), an indication to that effect on the LCD 15 may be displayed and, contrariwise, if having determined that the IC tag area can be positioned in the embroidery area (YES at S55 or YES at S80), the set positions of the IC tag area and the embroidery area may be displayed on the LCD 15. However, this processing may be omitted if such information does not need to be indicated. Further, in the first embodiment, the LCD 15 has been used as the second notification means. However, the present disclosure is not limited to this configuration; any other display device such as a plasma display or an audio device that uses a voice notification such as a speaker may be employed instead.

As described above, in the above-described first embodiment, it may be determined whether an IC tag area can be positioned in an embroidery area represented by relative coordinates when it is placed in an embroiderable area. If having determined that the IC tag can be positioned in the embroidery area, it is possible to position the embroidery area and the IC tag area in the embroiderable area. However, a position on a work cloth to which an IC tag is to be positioned may be determined in advance, to then determine whether the IC tag positioned at that position can be covered by an embroidery pattern. To do so, a scheme of the following second embodiment may be employed. The following will describe processing to determine beforehand a position on a work cloth shown in FIG. 10 to which an IC tag is to be positioned and then set an embroidery area so that the IC tag positioned at that position may be covered by an embroidery pattern by using the sewing machine 1 of the second embodiment with reference to the case of Example 1 exemplified in the first embodiment, along with FIGS. 22 through 25. It should be noted that programs to perform processing pieces shown in FIGS. 22 and 23 respectively may be stored in the ROM 62 beforehand and executed by the CPU 61 shown in FIG. 2. Further, various kinds of information used to perform the processing pieces shown in FIGS. 22 and 23 may be read from the ROM 62, the EEPROM 64, or the external storage device 39 and may be stored in a predetermined storage area in the RAM 63.

A physical configuration and an electrical configuration of a sewing machine in the second embodiment are the same as those of the first embodiment except for storage areas of the RAM 63. Therefore, description of the same configuration with the configuration of the first embodiment is omitted, to describe the storage areas of the RAM 63 which are different in configuration from those of the first embodiment. In addition to the storage areas of the RAM 63 of the first embodiment, the RAM 63 of the second embodiment may include an embroidery area location storage area (not shown) which stores a location of an embroidery area in an embroiderable area.

Figure 22:
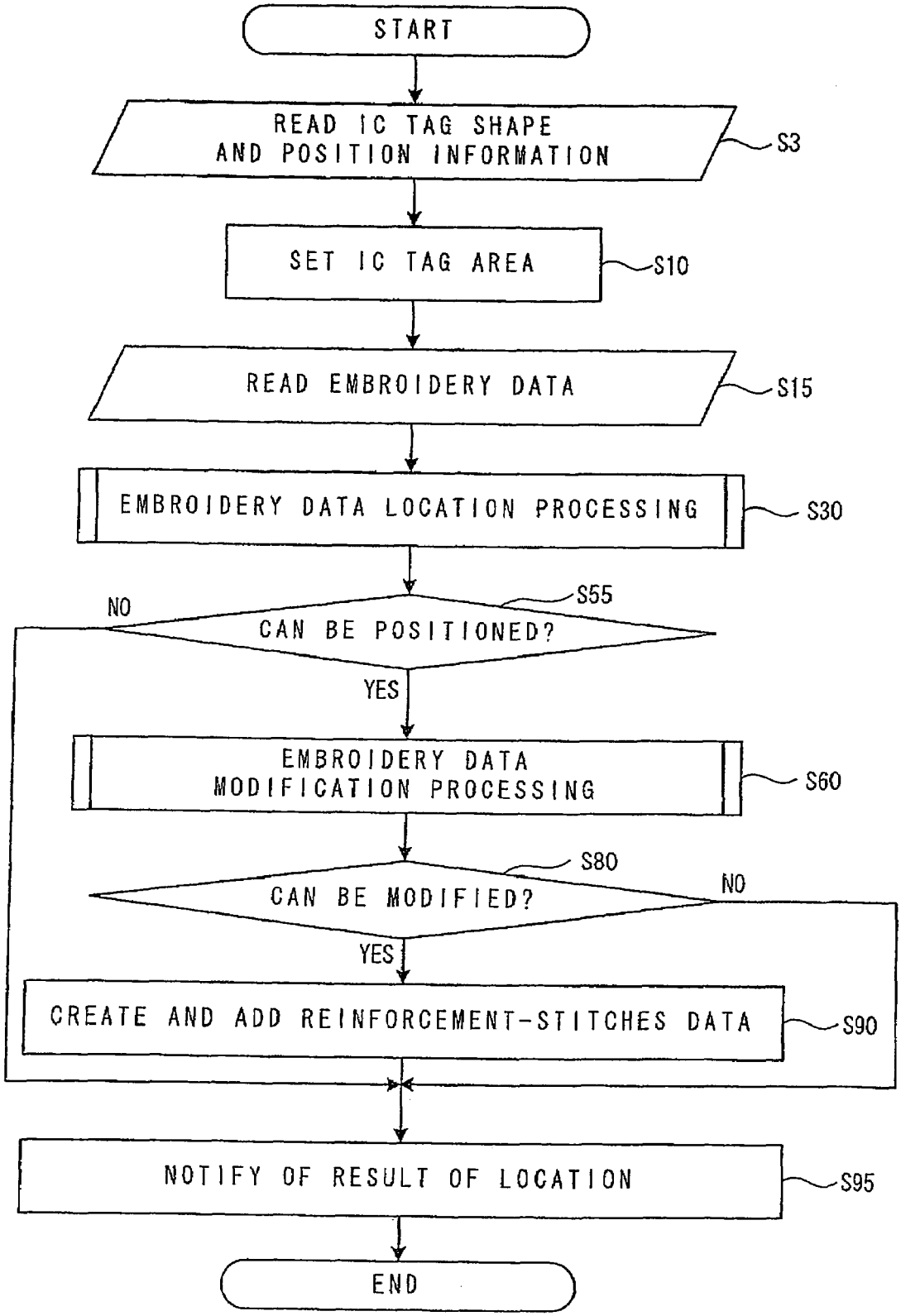
FIG. 22 is an explanatory flowchart of main processing of a second embodiment.

Main processing of the second embodiment shown in FIG. 22 is different from the main processing of the first embodiment shown in FIG. 8 in that it does not perform processing of S5, S20, S85, and S87 but does perform processing pieces of S3 and S30 of the main processing of the first embodiment. In the following description, the processing common to both of the main processing pieces will be omitted, to describe in detail S3 and S30 which are not performed in the main processing of the first embodiment shown in FIG. 8.

First, at S3 of FIG. 22, shape data of an IC tag 100 and position information of work cloth may be read and the shape data of the IC tag 100 may be stored in an IC tag shape storage area 631 in the RAM 63 and the position information of the work cloth for the IC tag 100 may be stored in the IC tag area location storage area 636 (S3). This processing may be performed in order to determine an IC tag area based on a size and shape of the IC tag 100 and acquire a position on the work cloth to which the IC tag is positioned. In the second embodiment, form information that represents the size and shape of the IC tag 100 may be acquired from an image scanner sensor 27 as shape data and may be stored in the IC tag shape storage area 631 in the RAM 63 (S3) and, simultaneously, position information of the IC tag 100 on the work cloth may be acquired from the image scanner sensor 27 and may be stored in the IC tag area position storage area 636 (S3). Through this processing, a position to which the IC tag is positioned in Example 1 is assumed to have been acquired as the position information of an IC tag area 131 positioned to a position indicated in an overlap area 761 inside an embroiderable area 651 shown in FIG. 24.

Next, embroidery data position processing which is performed at S30 of FIG. 22 will be described with reference to FIGS. 23 through 25. The embroidery data position processing shown in FIG. 23, which may be substituted for the IC tag position processing (S20) shown in FIG. 8, involves processing to position an IC tag area fixedly to a position indicated by position information acquired at S3 so that an embroidery area may be set in an embroiderable area.

Figure 23:
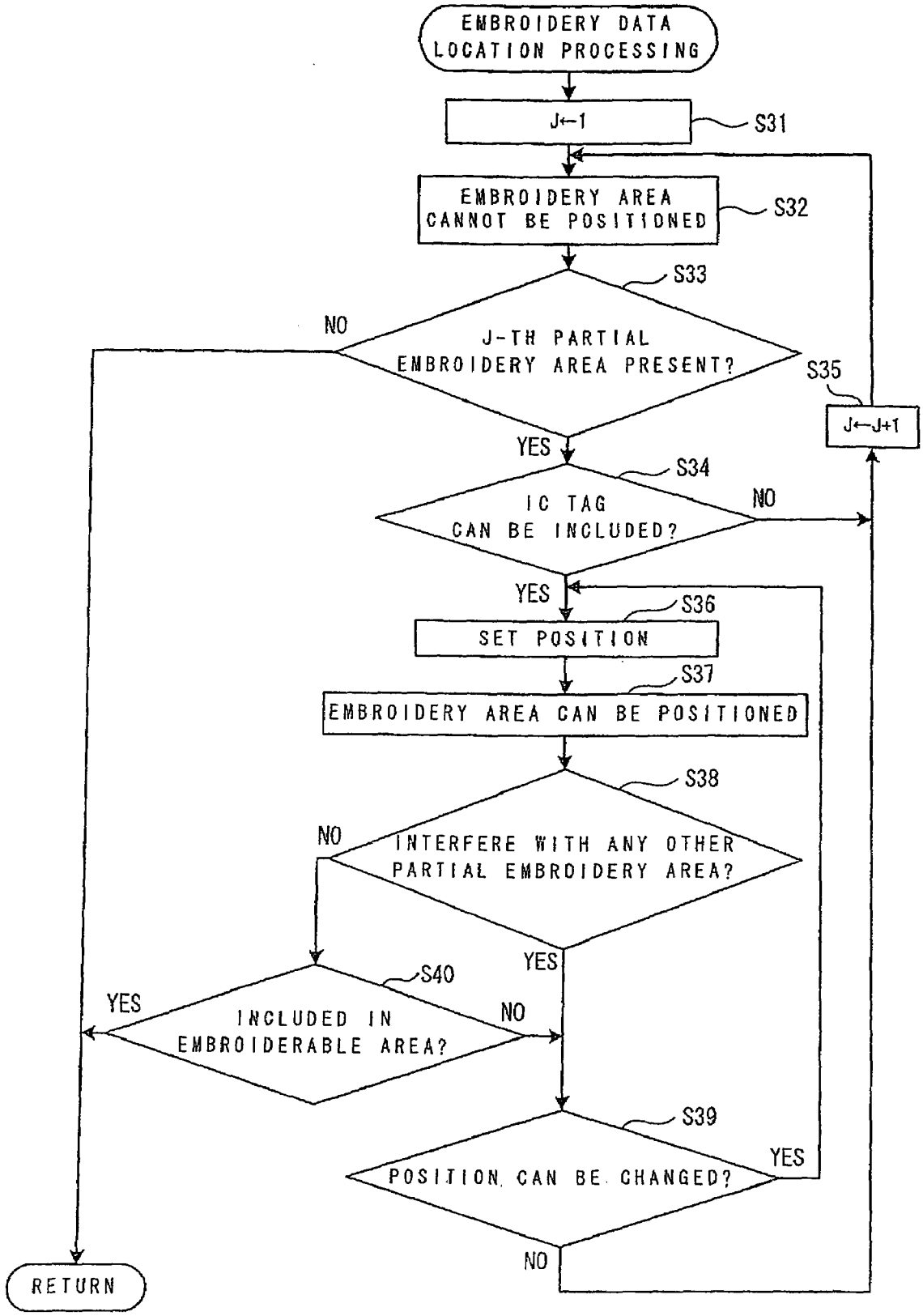
FIG. 23 is an explanatory flowchart of embroidery data position processing which is performed in the main processing shown in FIG. 22.

In the embroidery data location processing shown in FIG. 23, first "1" may be set to a partial embroidery area counter J, which may be used to read partial embroidery areas in sequence, and stored in a partial embroidery area counter storage area 634 (S31). Subsequently, an IC tag location flag, based on which to determine whether an IC tag area can be positioned in the embroidery area, may be set to "0", which indicates that the IC tag area cannot be positioned in the embroidery area, and stored in the IC tag location flag storage area 635 (S32). Subsequently, the embroidery data storage area 633 and the partial embroidery area counter storage area 634 may be referred to in order to determine whether there is a J-th partial embroidery area (S33). If having determined that there is no J-th partial embroidery area (NO at S33), it may be determined that all the partial embroidery areas have been checked to determine whether the IC tag area is included therein and the embroidery data location processing may end and the process may return to the main processing shown in FIG. 22.

On the other hand, an embroidery area 210 of Example 1 may include first through third partial embroidery areas 201 through 203 (YES at S33). Therefore, the IC tag area storage area 632, the embroidery data storage area 633, and the partial embroidery area counter storage area 634 may be referred to in order to determine whether the IC tag area can be included in the J-th partial embroidery area (S34). In this processing, relocation of the J-th partial embroidery area to a relatively different position may be repeated in a predetermined condition and, upon each relocation, it may be determined whether the IC tag area is included in the embroidery area. The predetermined condition may be, for example, that relocation is repeated until all of the location combinations are checked. As a result, if having determined at least once that the IC tag area is already included, it may be determined that the IC tag area can be included in a partial embroidery area determined on the basis of embroidery data. If having determined that the IC tag area cannot be included in the embroidery area (NO at S34), to read the next partial embroidery area subsequently, the partial embroidery area counter J may be incremented by 1. Then, the partial embroidery area counter J may be stored in the partial embroidery area counter storage area 634 (S35), to repeat the processing from S32.

Figure 24:
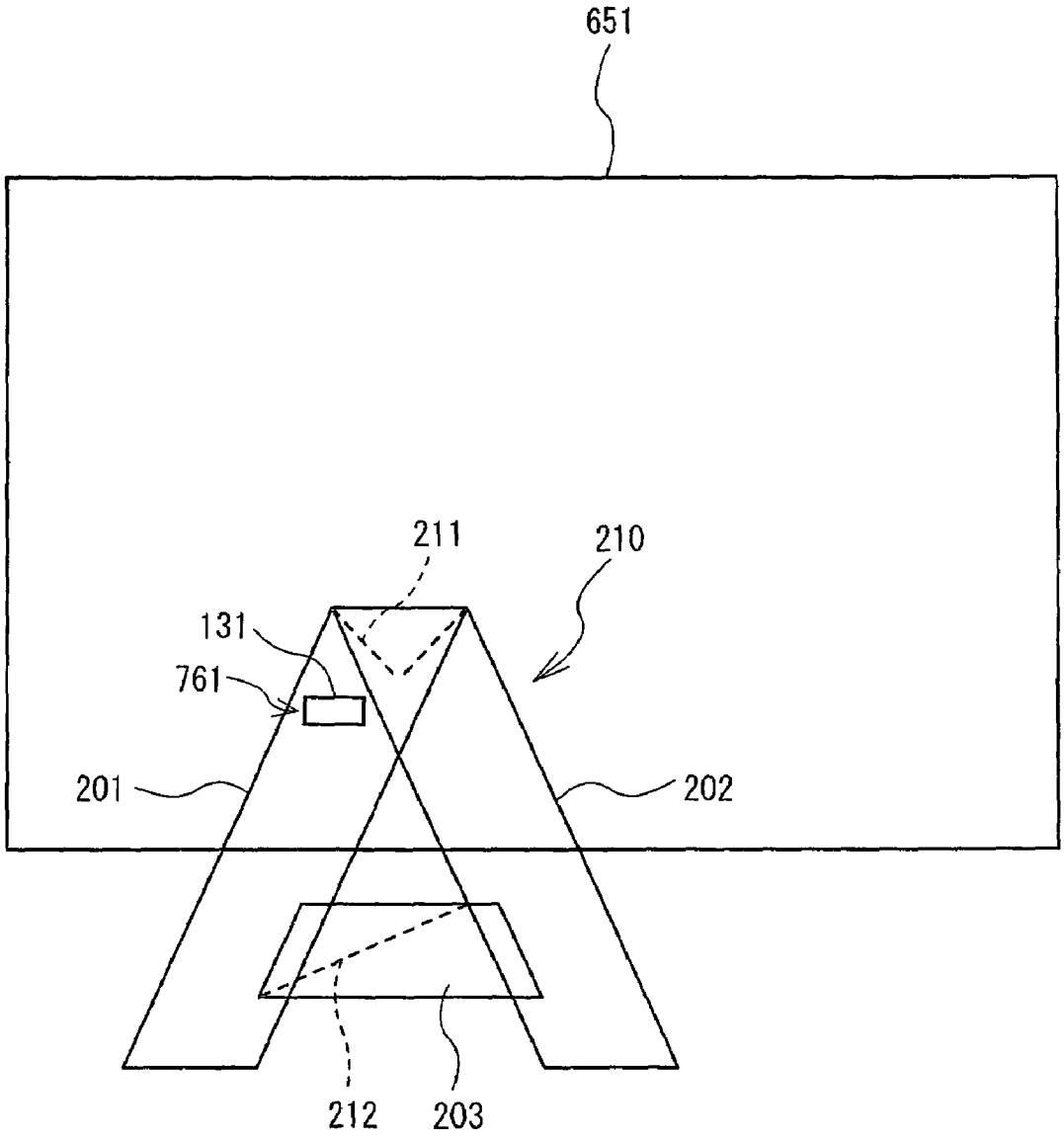
FIG. 24 is an explanatory diagram of a case where an embroidery area is located outside an embroiderable area by the embroidery data position processing shown in FIG. 23.

On the other hand, the following will describe a case where, it may be determined that an IC tag area 131 positioned in an embroiderable area 651 as in Example 1 shown in FIG. 24 can be included in partial embroidery area 201 of an embroidery area 210. In this case, it may be determined that the IC tag area can be positioned in the first partial embroidery area 201 (YES at S34) and, subsequently, a location of the embroidery area 210 may be set as shown in FIG. 24 and may be stored in an embroidery area location storage area (not shown) (S36). Subsequently, the IC tag location flag may be set to "1", which indicates that the IC tag area can be positioned in the embroidery area, and stored in the IC tag location flag storage area 635 (S37).

Subsequently, the embroidery data storage area 633, the IC tag area location storage area 636, and the embroidery area storage location area (not shown) may be referred to in order to determine whether the IC tag area positioned to the position set at S36 interferes with any other partial embroidery area (S38). This processing may be determined by a similar processing with S28 of FIG. 9, for example. If having determined that the IC tag area interferes with any embroidery area other than the J-th partial embroidery area (YES at S38), it may be determined that the IC tag area needs to be relocated. Subsequently, whether the IC tag area can be relocated within the J-th partial embroidery area may be determined (S39).

On the other hand, if the embroidery area 210 of Example 1 is positioned as shown in FIG. 24, it may be determined that the IC tag area 131 does not interfere with the partial embroidery areas 202 and 203 other than the first partial embroidery area (NO at S38). Subsequently, the embroidery area location storage area (not shown) may be referred to in order to determine whether an embroidery area is included in an embroiderable area (S40). This processing may be performed to position an embroidery area in an embroiderable area. If the embroidery area 210 of Example 1 is positioned as shown in FIG. 24, the embroidery area 210 may be partially outside the embroiderable area 651, so that it may be determined that the embroidery area 210 cannot be included in the embroiderable area 651 (NO at S40). In this case, a position of the embroidery area 210 generally needs to be changed, so that subsequently whether the position of the IC tag area can be changed within the J-th partial embroidery area may be determined (S39). If having determined that the position of the IC tag area cannot be changed (NO at S39), to read the next partial embroidery area, the partial embroidery area counter J may be incremented by 1 and stored in the partial embroidery area counter storage area 634 (S35), to repeat the processing from S32 again.

Figure 25:
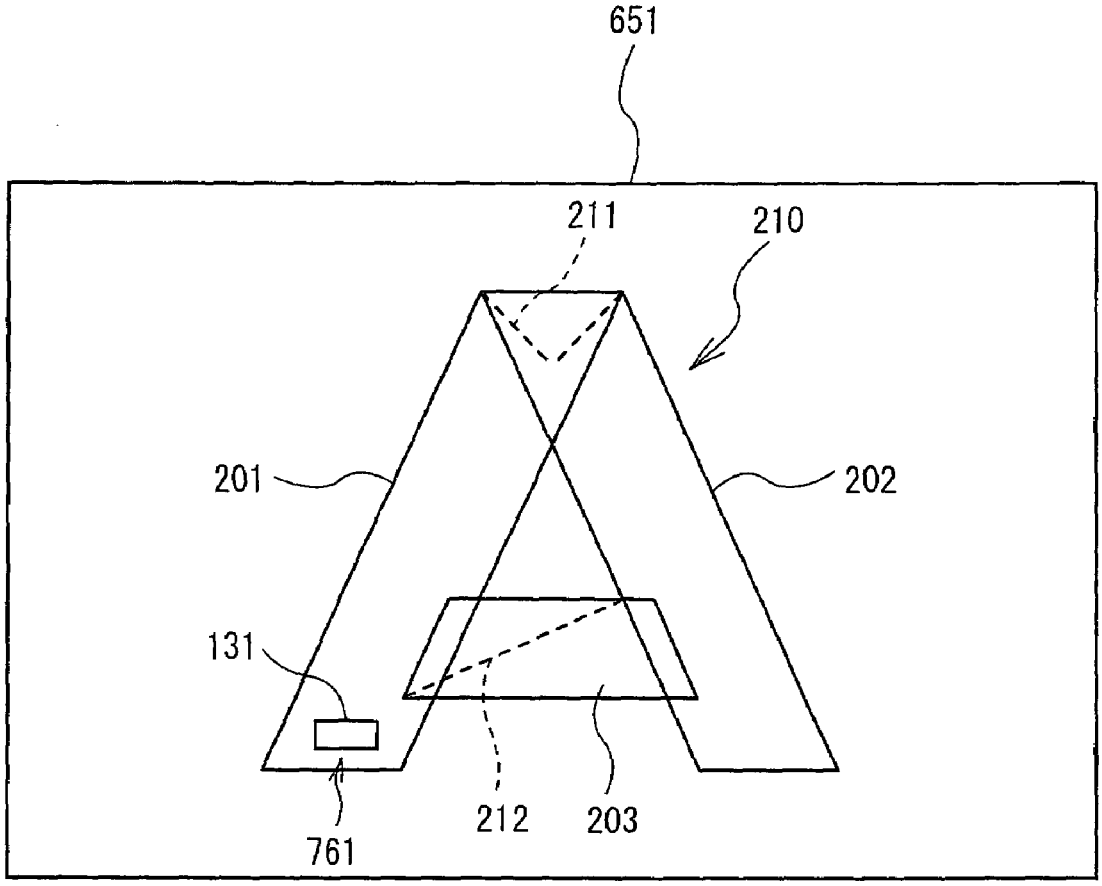
FIG. 25 is an explanatory diagram of a case where an embroidery area is located inside an embroiderable area by the embroidery data position processing shown in FIG. 23.

On the other hand, in Example 1, it may be determined that the position can be changed (YES at S39) and the embroidery area 210 may be relocated to a position different from that in FIG. 24 so that the IC tag area 131 may be included in the first partial embroidery area 201 as shown, for example, in FIG. 25 (S36). Subsequently, the IC tag location flag is set again to "1", which indicates that the IC tag area can be positioned in the embroidery area, and may be stored in the IC tag location flag storage area 635 (S37). Then, it may be determined that the IC tag area 131 shown in FIG. 25 does not interfere with the partial embroidery areas 202 and 203 other than the first partial embroidery area (NO at S38). Subsequently, the embroidery area location storage area (not shown) may be referred to in order to determine that the embroidery area 210 is included in the embroiderable area 651 shown in FIG. 25 (YES at S40). In this case, it may be determined that the embroidery area 210 need not be set again and so then the embroidery data position processing may end to return to the main processing of FIG. 22.

As described in detail above, according to the sewing machine 1 equipped with an embroidery data processing apparatus of the second embodiment, whether an embroidery area can be positioned in an embroiderable area may be determined in a condition where a location on a work cloth to which an IC tag is position is fixed. If it is determined that the embroidery area can be positioned (YES at S55), the same embroidery data modification processing as that of the first embodiment may be performed (S60). In the second embodiment, a location of an IC tag is fixed, so that in contrast to the first embodiment, the processing does not require the processing to create and add mark sewing data used to form stitches that serve as a mark when positioning an IC tag on a work cloth (S85 of FIG. 8) and does not require the processing to add pause data (S87 of S8).

According to the second embodiment detailed above, it is possible to acquire position information indicating a position on a work cloth to which the IC tag 100 is positioned and fix the position of the IC tag on the work cloth and then determine a location of an embroidery pattern 200 so that the IC tag 100 attached to the work cloth may be covered by the embroidery pattern 200. Therefore, in a case where a position on a work cloth to which an IC tag is positioned is already set, it is possible to set a position of an embroidery pattern that matches the position of the IC tag in accordance with positions of the embroidery area 210 and the IC tag area 131 which are determined by the embroidery data processing apparatus of the present disclosure.

It should be noted that the present disclosure is not limited to the second embodiment described in detail above and can be changed in a variety of manners without departing from the spirit and scope of this disclosure, as characterized in the appended claims. For example, although the second embodiment may acquire the position information of the IC tag through the image scanner sensor 27 at S3 of FIG. 22, the present disclosure is not limited to this configuration; for example, the position information of the IC tag may be entered by a user. Further, the second embodiment does not need to perform the processing to create and add mark sewing data used to form stitches that serve as a mark when positioning an IC tag to a work cloth. However, if it is desired to form the stitches that serve as the mark because, for example, the location of the IC tag is shifted after the position information is acquired or the position information of the IC tag is entered by hand, the processing to create and add the mark sewing data may be performed.

Further, in the second embodiment, the position information of an IC tag may be acquired at S3 of FIG. 22 to fix an IC tag area to a position indicated by the position information and then to position the IC tag area in an embroidery area. However, the present disclosure is not limited to this configuration, so that the position information of positions of an IC tag area and an embroidery area may be acquired to fix the IC tag area and the embroidery area to positions indicated by the position information and then to determine whether the IC tag area is included in the embroidery area. In this case, for example, a user may enter the position information of the IC tag as well as the position information used when positioning an embroidery pattern so that whether an IC tag area positioned at a position specified by the user is included in that embroidery area positioned at a specified position is determined and, if having determined that the IC tag area is included, the positions of the embroidery area and the IC tag area may be set to the specified positions in an embroiderable area of the sewing machine 1. It should be noted that a touch panel 26 may be replaced with any one of various switches, a trackball, or a joystick on a game controller that interfaces with the user.

In the above-described first and second embodiments, whether an IC tag area can be positioned in an embroidery area may be determined and the embroidery area and the IC tag area are set automatically. However, as in a third embodiment to be described next, a position in an embroidery area to which an IC tag area is positioned may be selected by the user. The following will describe processing where a user may select a position in an embroidery area to which an IC tag is positioned by using a sewing machine 1 equipped with an embroidery data processing apparatus of the third embodiment and set an IC tag area and an embroidery area in an embroiderable area, with reference to FIGS. 26 through 29. It should be noted that programs to perform various processing pieces shown in FIGS. 26 and 27 respectively may be stored in the ROM 62 beforehand and executed by the CPU 61 shown in FIG. 2. Further, various kinds of information used to perform the processing pieces shown in FIGS. 26 and 27 may be read from the ROM 62, the EEPROM 64, or the external storage device 39 and stored in a predetermined storage area in the RAM 63.

A physical configuration and an electrical configuration of the sewing machine 1 equipped with an embroidery data processing apparatus of the third embodiment are the same as those of the first embodiment except for storage areas of an RAM 63, so that description of the same configuration with the first embodiment is omitted and, instead, the storage areas of the RAM 63 which are different in configuration from those of the first embodiment will be described below. In addition to the storage areas of the RAM 63 of the first embodiment, the RAM 63 of the third embodiment may have an includable area storage area (not shown).

Figure 26:
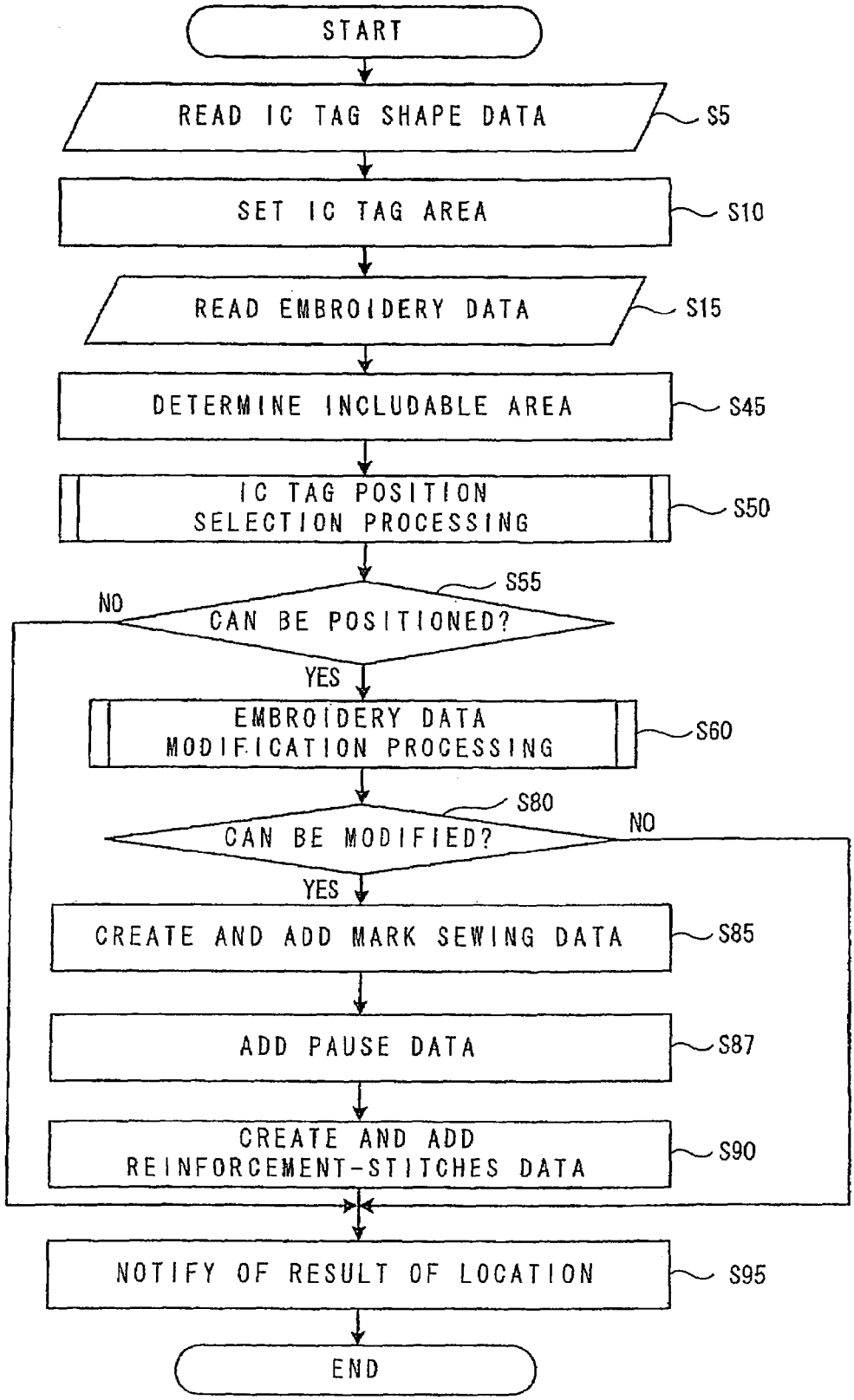
FIG. 26 is an explanatory flowchart of main processing of a third embodiment.

Main processing of the third embodiment shown in FIG. 26 is different from the main processing of the first embodiment shown in FIG. 8 in that it does not perform the processing of S20 but it does perform the processing pieces of S45 and S50 of the main processing of the first embodiment shown in FIG. 8. In the following description, the processing common to both of the main processing pieces will be omitted, to describe in detail S45 and S50 which were not performed in the main processing of the first embodiment shown in FIG. 8.

Figure 28:
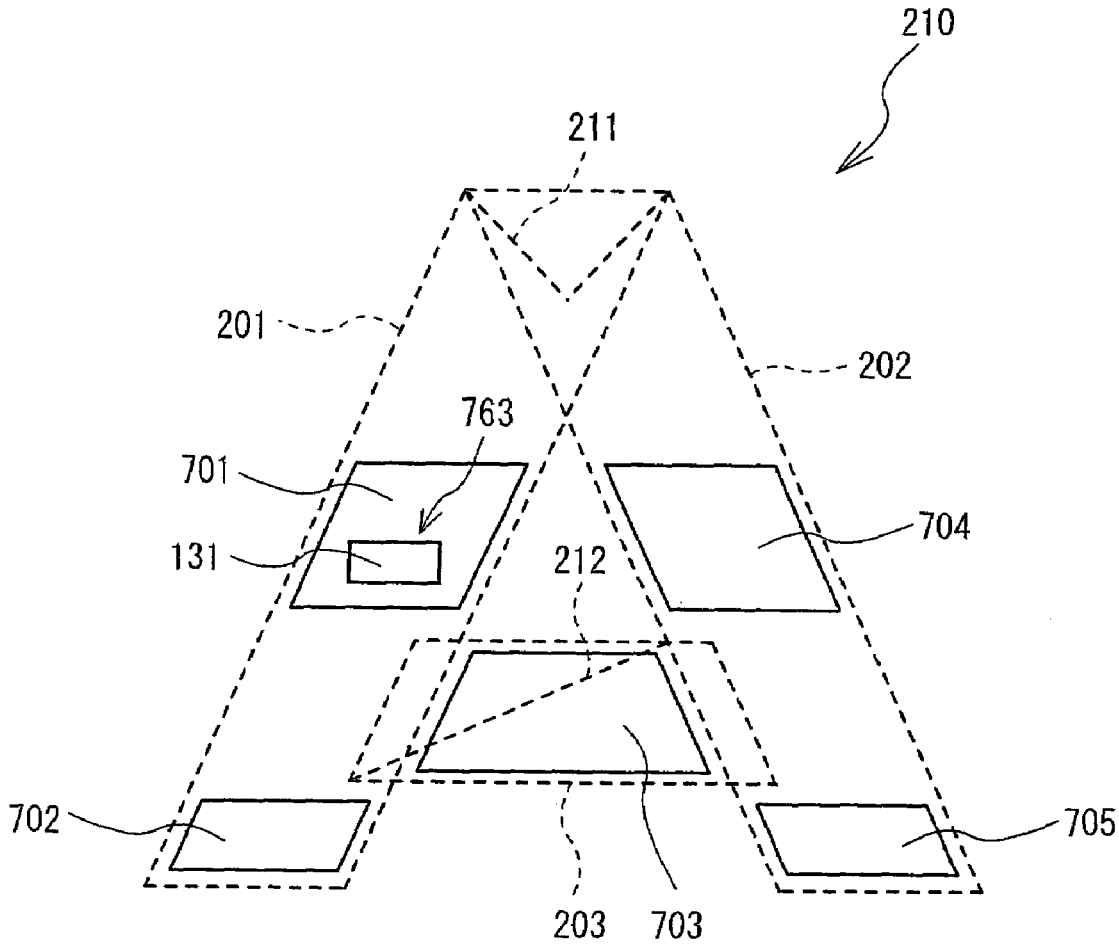
FIG. 28 is an explanatory diagram of candidates for an includable area determined by the IC tag position selection processing shown in FIG. 27.
Figure 29:
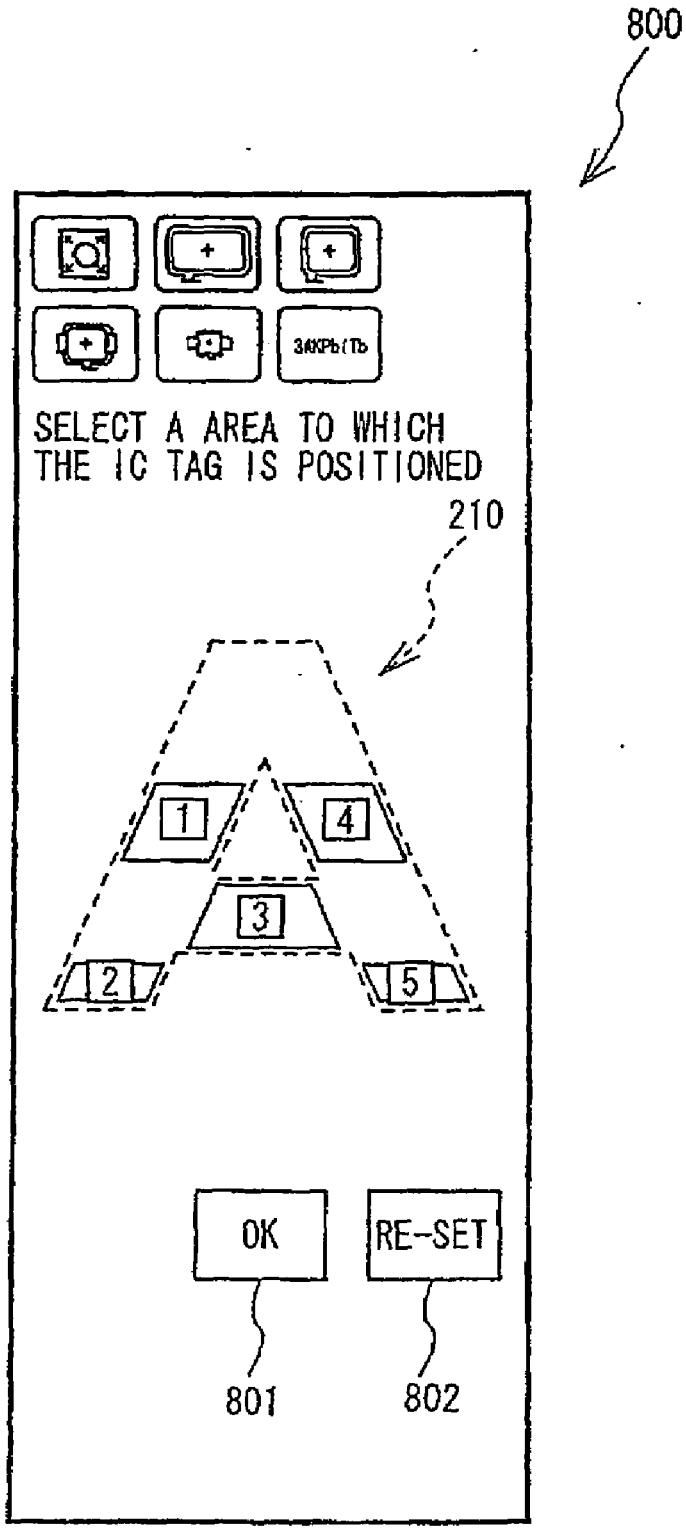
FIG. 29 is an explanatory diagram of a screen which is displayed on a liquid crystal display (LCD) in the IC tag position selection processing shown in FIG. 27.

In the main processing of the third embodiment, it may be determined beforehand which part of embroidery areas can include an IC tag area and embroidery areas that can include the IC tag area may be determined as includable areas. The includable areas may be displayed on the LCD 15, to allow a user to select a desired one of the includable areas, which are candidates for positioning the IC tag area therein. At S45 of the main processing of FIG. 26, includable areas may be determined (S45). In this processing, for example, relocation of the IC tag area to a relatively different position with respect to the embroidery area until a predetermined condition is met, which is, for example, that all of location combinations are checked and, upon each relocation, it may be determined whether the IC tag area is included in the embroidery area. As a result, if having determined that the IC tag area can be included, an overlap area where the IC tag area and the embroidery area overlap with each other may be stored in a includable area storage area (not shown) of a RAM 63 as a includable area, thereby determining the includable area. Through this processing, it is supposed that as shown in FIG. 28, five includable areas 701 through 705 may be determined in the embroidery area 210 of Example 1 and stored in the includable area storage area (not shown) in the RAM 63.

Figure 27:
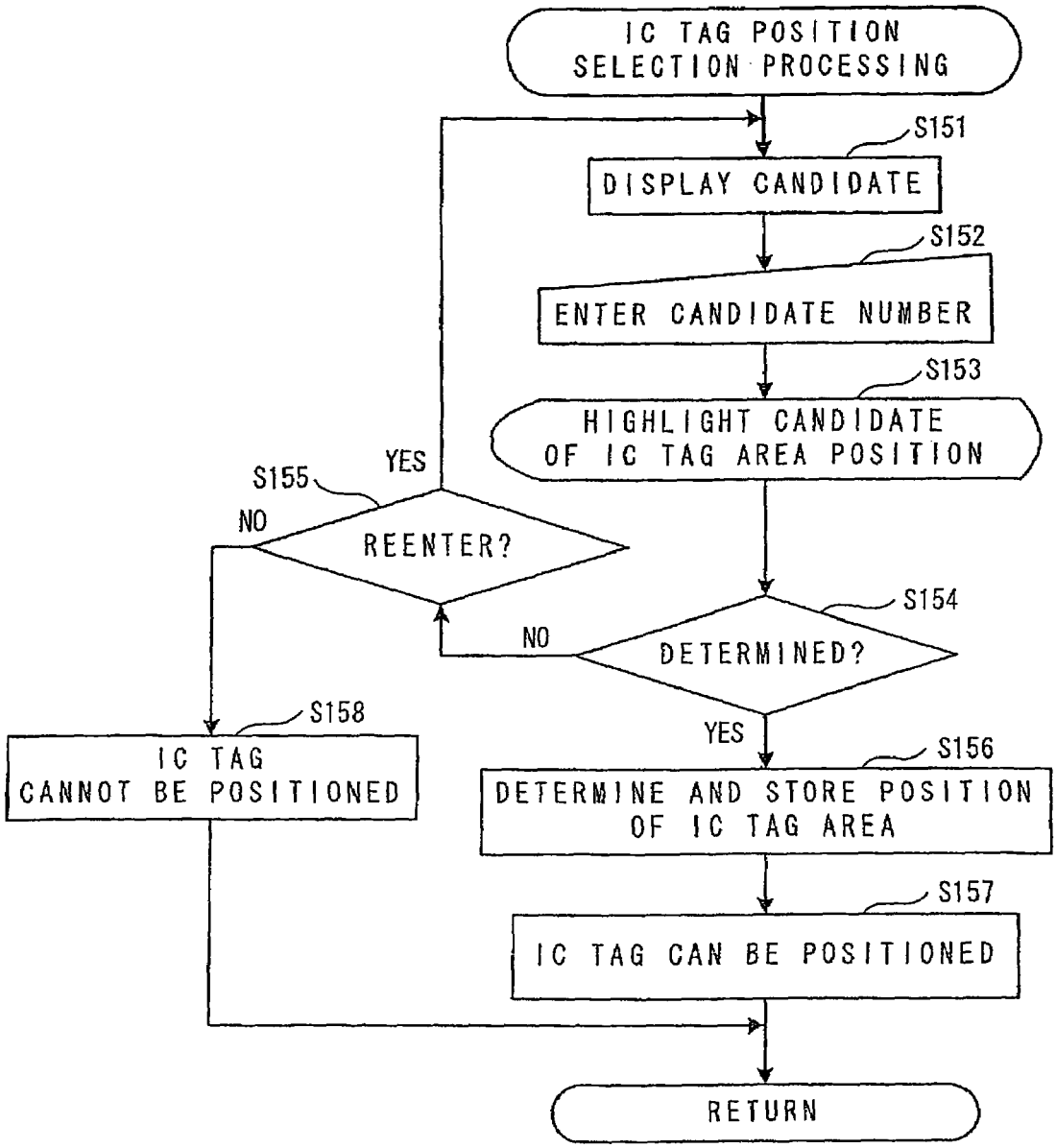
FIG. 27 is an explanatory flowchart of IC tag position selection processing which is performed in the main processing shown in FIG. 26.

Next, IC tag position selection processing which may be performed at S50 of FIG. 26 will be described below with reference to a flowchart shown in FIG. 27. In the IC tag position selection processing of FIG. 27, first, the includable area determined at S45 of FIG. 26 may be displayed on the LCD 15 as a candidate for positioning the IC tag area therein (S151). Through this processing, it may be assumed that the includable area in the embroidery area 210 of an embroidery pattern of Example 1 has been displayed as a screen 800 shown in FIG. 29. By selecting one of buttons 1 through 5 on the screen 800, the user can specify an includable area in which the IC tag area is to be positioned. Subsequently, if an includable area in which to position the IC tag area is selected and entered on the touch panel 26 (S152), the selected includable area may be highlighted in such a manner as to be differentiated from the other includable areas (S153). In Example 1, "1" which selects the includable area 701 from among the includable areas 701 through 705 may be entered, so that the LCD 15 indicates the includable area 701 in a color different from other includable areas 702 through 705.

Subsequently, if an instruction which determines to position the IC tag area in the includable area highlighted at S153 is entered by pressing a button 801 on the screen 800 through the touch panel 26 (YES at S154), the IC tag area may be set in the includable area entered at S152. Then, the IC tag area may be stored in the IC tag area storage area 636 (S156). In Example 1, through this processing, the IC tag area 131 may be positioned in the includable area 701 as shown in an overlap area 763 of FIG. 28. Subsequently, an IC tag location flag may be set to "1", which indicates that the IC tag area can be positioned in an embroidery area, and stored in the IC tag location flag storage area 635 (S157). Then, the IC tag position selection processing may end and the process may return to the main processing shown in FIG. 26.

On the other hand, if the instruction which determines to position the IC tag area in the includable area highlighted at S153 is not entered but, instead, an instruction to reenter a candidate number is entered by pressing a button 802 on the screen 800 (NO at S154, YES at S155), the process may return to S151 to repeat the processing. If, through the touch panel 26, an instruction which determines to position the IC tag area in the includable area highlighted at S153 is not entered, nor an instruction to reenter the candidate number is not entered (NO at S154, NO at S155), it is determined that the IC tag area is not positioned. Subsequently, the IC tag location flag may be set to "0", which indicates that the IC tag area cannot be positioned in the embroidery area, and stored in the IC tag location flag storage area 635 (S158). Subsequently, the IC tag position selection processing may end and the process may return to the main processing shown in FIG. 26.

As described in detail above, in the sewing machine 1 equipped with an embroidery data processing apparatus of the third embodiment, embroidery areas capable of positioning an IC tag area therein may be determined as includable areas and one of the includable areas may be selected as an area to position the IC tag area therein. Then, a position of the IC tag area may be set in the selected includable area.

As detailed above, according to the sewing machine 1 which is equipped with the embroidery data processing apparatus of the third embodiment, the touch panel 26 may be provided to position the IC tag area among includable areas displayed on the LCD 15, so that it is possible to set the position of the IC tag area to a desired position in the indicated includable area.

It should be noted that the present disclosure is not limited to the third embodiment described in detail above and can be changed in a variety of manners without departing from the spirit and scope of the disclosure, as characterized in the appended claims.

Although, in the third embodiment is described for use with the touch panel 26, it may be replaced with any one of various switches, a trackball, or a joystick on a game controller that interfaces with the user. Further, although in the third embodiment, the LCD 15 may be used, the present disclosure is not limited to this configuration; any other display device such as a plasma display or an audio device that uses a voice notification such as a speaker may be employed instead.

In the above-described first through third embodiments, an embroidery area may be set on the basis of embroidery data stored beforehand in a predetermined storage area, to determine whether an IC tag area can be positioned in that embroidery area. However, as in a fourth embodiment described next, an embroidery area may be determined on the basis of a specified profile to determine whether an IC tag area can be positioned in this embroidery area, and if it is determined that the IC tag can be positioned in that embroidery area, embroidery data of the specified embroidery area may be newly created. The following will describe, with reference to FIGS. 30 and 31, processing to use a sewing machine 1 equipped with an embroidery data processing apparatus of the fourth embodiment to, if it is determined that an IC tag area can be positioned in an embroidery area determined on the basis of a specified profile, and newly create embroidery data for a specified embroidery area. It should be noted that programs to perform various kinds of processing pieces shown in FIG. 30 may be stored in the ROM 62 beforehand and may be executed by the CPU 61 shown in FIG. 2. Further, various kinds of information used to perform the various processing pieces shown in FIG. 30 may be read from the ROM 62, the EEPROM 64, or the external storage device 39 and may be stored in a predetermined storage area in the RAM 63 beforehand.

A physical configuration and an electrical configuration of the sewing machine 1 equipped with an embroidery data processing apparatus of the fourth embodiment are the same as those of the first embodiment except for storage areas of the RAM 63, so that description of the same configuration having the same configuration with the first embodiment is omitted and, instead, the storage areas of the RAM 63 which are different in configuration from those of the first embodiment will be described below. In addition to the storage areas of the RAM 63 of the first embodiment shown in FIG. 3, the RAM 63 of the fourth embodiment may have a profile line storage area (not shown) which may store profile line data and an embroidery area storage area (not shown) which may store an embroidery area.

Figure 30:
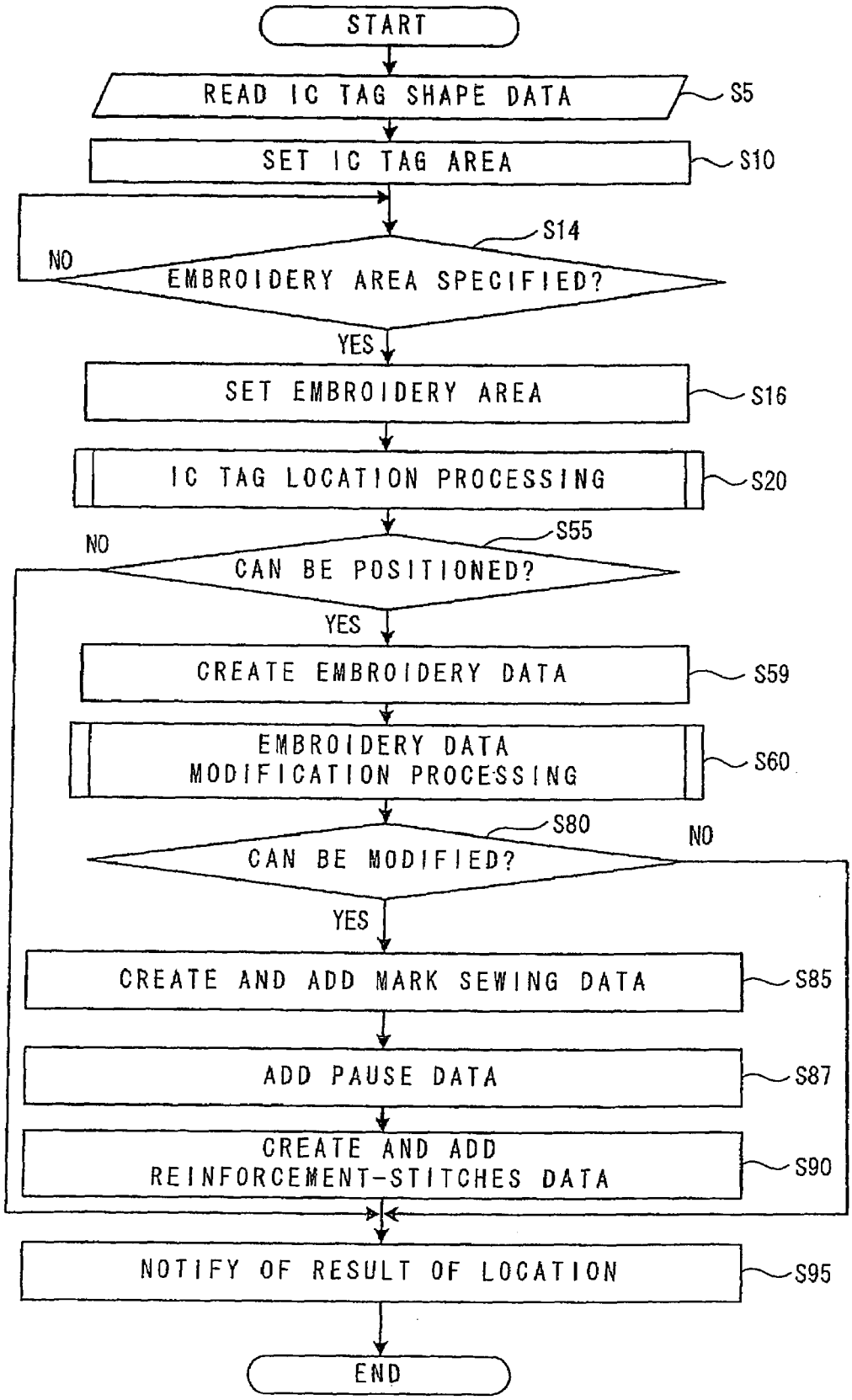
FIG. 30 is an explanatory flowchart of main processing of a fourth embodiment.
Figure 31:
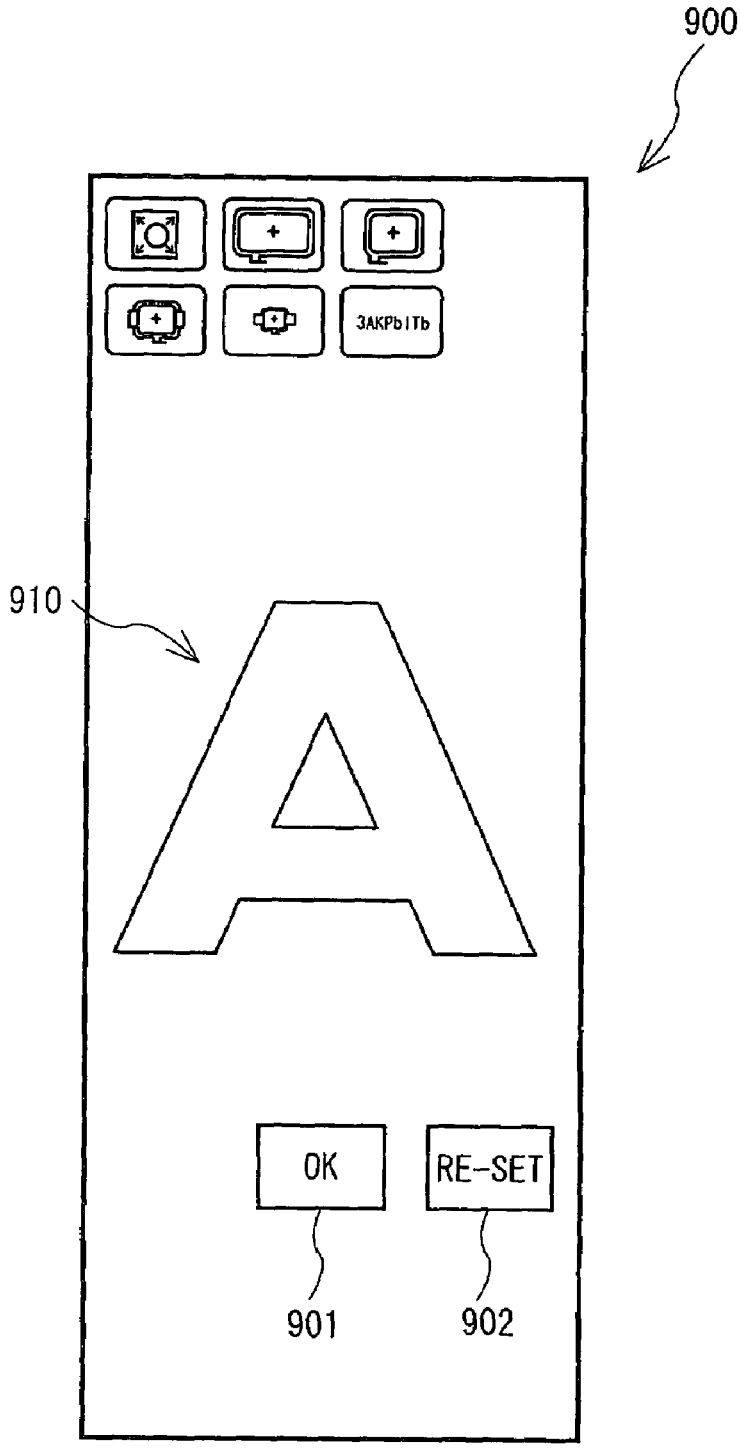
FIG. 31 is an explanatory diagram of a screen on which a profile of an embroidery pattern specified by the main processing shown in FIG. 30 is displayed.

Main processing of the fourth embodiment shown in FIG. 30 is different from the main processing of the first embodiment shown in FIG. 8 in that it does not perform the processing of S15 but does perform the processing pieces of S14, S16, and S59. In the following, the processing common to both main processing pieces will be omitted, to describe in detail S14, S16 and S59 which are not performed in the main processing of the first embodiment shown in FIG. 8.

In the main processing of the fourth embodiment, an embroidery area based on a graphic profile specified by a user may be used to determine whether an IC tag area can be positioned in that embroidery area, and if having determined that the IC tag area can be positioned in that embroidery area, embroidery data of the specified embroidery area may be newly created. Therefore, at S14 of FIG. 30, after a profile of an embroidery pattern is entered, it may be determined whether an embroidery area is specified (S14). This processing may be performed to determine an embroidery area based on a graphic profile specified by the user. The profile may be entered, for example, by entering a profile of an embroidery pattern with a touch pen etc. into an embroiderable area which may be displayed on the LCD 15. Further, a profile line may be extracted from images such as photos and illustrations specified by the user which may be stored beforehand in the ROM 62, the external storage device 39 and so on. Still further, the profile line may be extracted from images acquired from the image scanner sensor 27. If having determined at S14 that no embroidery areas are specified because no profile lines are specified by the user (NO at S14), the next processing is not performed until a profile line is specified. On the other hand, if having determined that a profile line is specified by the user and an embroidery area is specified (YES at S14), the profile line data indicative of the profile line may be stored in a profile line storage area (not shown) in the RAM 63 and, subsequently, an embroidery area may be set and stored in an embroidery area storage area (not shown) in the RAM 63 (S16). In Example 2, it may be assumed that a profile 910 of alphabet "A" is entered as a screen 900 shown in FIG. 31 using the touch pen and an area within the profile 910 may be set as an embroidery area.

Next, processing of S59 will be described below. At S59, the profile line storage area (not shown) and the embroidery area storage area (not shown) in the RAM 63 may be referred to in order to create embroidery data having the profile entered at S14 as a profile of an embroidery pattern and to store the data in the embroidery data storage area 633 (S59). To create the embroidery data, a heretofore known method can be employed for creating embroidery data; as described in Japanese Patent Application Laid Open Publication No. Hei 06-084585, for example, block data may be created which represents positions of vertexes of a plurality of blocks into which a closed area specified by a profile line is subdivided, to determine whether each of the blocks is a branch source. If a block is determined to be a branch source, prior to embroidering the branch source block, running stitch data may be calculated that indicates a sewing path along which running sewing is performed from that branch source block to the top of the top block in the branch destination block row and stitch data may be created based on the block data so that an embroidery may be sewn in an opposite direction from a destination of that running sewing to the branch source block, thereby creating embroidery data. By this processing, embroidery data shown in the above-described FIG. 8, for example, may be created as embroidery data of Example 2 and may be stored in the embroidery data storage area 633. It should be noted that in this processing, the user may specify various settings such as thread color data and a sewing width employed when sewing the blocks to be added to embroidery data. Otherwise, various kinds of settings may be made on the basis of settings which may be stored in the ROM 62 beforehand and may be added to the embroidery data.

As described in detail above, in the sewing machine 1 equipped with a sewing processing apparatus of the fourth embodiment, an embroidery area may be set on the basis of a profile of a specified embroidery pattern, to determine whether an IC tag area can be included in that embroidery area. If having determined that the IC tag area can be included, embroidery data of an embroidery pattern having the specified profile may be created (S59) and a modification may be made so that a needle drop point for sewing the embroidery pattern is not provided in an overlap area where the embroidery area and the IC tag area overlap with each other (S60). That is, by performing the processing of S59 and S60, it is possible to create embroidery data of an embroidery pattern having a specified profile so that a needle drop point for sewing the embroidery pattern is not provided in an overlap area where the embroidery area and the IC tag area overlap with each other (S59, S60).

According to the above-described sewing machine 1 equipped with the embroidery data processing apparatus of the fourth embodiment, an embroidery area may be set on the basis of a profile of a specified embroidery pattern, to determine whether an IC tag area can be included in that embroidery area. If having determined that the IC tag area can be included, embroidery data of an embroidery pattern having the specified profile may be created so that a needle drop point for sewing the embroidery pattern is not provided in an overlap area where the embroidery area and the IC tag area overlap with each other. It is thus possible to newly create embroidery data so that an IC tag is covered by an embroidery pattern.

It should be noted that the present disclosure is not limited to the fourth embodiment described in detail above and can be changed in a variety of manners without departing from the spirit and scope of the disclosure, as characterized in the appended claims.

For example, although the fourth embodiment has been described as using the touch panel 26, the touch panel may be replaced with any one of various switches, a trackball, or a joystick on a game controller that interfaces with the user.

Although the fourth embodiment has been described with reference to a case where so-called block data is created as embroidery data at S59 of FIG. 30, the present disclosure is not limited to block data; for example, so-called one-stitch data may be created.

According to the above-described embroidery data processing apparatus and a computer-readable recording medium in which an embroidery data processing computer program for causing the embroidery data processing apparatus to perform processing is recorded, it is possible to set positions of an embroidery pattern area and an IC tag area of an IC tag attached to a work cloth, in such a manner that the IC tag area may be included in the embroidery area. Therefore, according to the locations of an embroidery area and an IC tag area set by an embroidery data processing apparatus of the present disclosure, it is possible to cover an IC tag attached to the work cloth by an embroidery pattern, thereby attaching the IC tag capable of holding a lot of information on the work cloth without damaging a design of the work cloth.

Further, according to the above-described embroidery data processing apparatus and computer-readable recording medium in which the embroidery data processing computer program for causing this embroidery data processing apparatus to perform the processing is recorded, in a case where an embroidery area and an IC tag area are specified to desired positions in an embroiderable area, it is possible to set the positions of the embroidery area and the IC tag area to the specified positions based on whether the IC tag area is included in that embroidery area.

Further, according to a sewing machine equipped with the above-described embroidery data processing apparatus, the above-described embroidery data processing apparatus is provided, so that similar advantages as those described above in connection with the apparatus can be obtained.

What is claimed is:

1. An embroidery data processing apparatus which processes embroidery data used to embroider an embroidery pattern on a work cloth by using a sewing machine capable of embroidering, the embroidery data processing apparatus comprising:

an IC tag area acquisition device that acquires an IC tag area which is determined on the basis of a size and shape of an IC tag;

a determination device that determines whether the IC tag area can be included in an embroidery area which is determined on the basis of the embroidery data; and a location setting device that, if the determination device determines that the IC tag area can be included in the embroidery area, sets positions of the embroidery area and the IC tag area in an embroiderable area of the sewing machine in such a manner that the IC tag area may be positioned in the embroidery area.

2. The embroidery data processing apparatus according to claim 1, wherein the determination device comprises:

an initial location device that positions the embroidery area and the IC tag area in the embroiderable area;

a location repeating device that repeatedly repositions the embroidery area and the IC tag area to relatively different positions until a predetermined condition is satisfied;

an inclusion determination device that, if the embroidery area and the IC tag area are positioned by the initial location device or the location repeating device, determines whether the IC tag area is included in the embroidery area; and an overall determination device that, if the inclusion determination device determines at least once that the IC tag area is included in the embroidery area, determines that the IC tag area can be included in the embroidery area.

3. The embroidery data processing apparatus according to claim 1, further comprising:

a position information acquisition device that acquires position information which indicates a position of the IC tag in the embroiderable area of the sewing machine, wherein if the determination device determines that the IC tag area can be included in the embroidery area, the location setting device causes the IC tag area to be positioned in the embroidery area and sets the position of the embroidery area in the embroiderable area of the sewing machine in a condition where the position of the IC tag is fixed to the position corresponding to the position information acquired by the position information acquisition device.

4. The embroidery data processing apparatus according to claim 1, further comprising:

an embroidery data creation device that creates the embroidery data, and a profile specification device that specifies a profile of the embroidery pattern, wherein the determination device sets an inside of a profile specified by the profile specification device as an embroidery area and determines whether the IC tag area can be included in the embroidery area, and if the determination device determines that the IC tag area can be included in the embroidery area, the embroidery data creation device creates the embroidery data of the embroidery pattern having the profile specified by the profile specification device so that a needle drop point for sewing the embroidery pattern is not provided in an overlap area where the embroidery area and the IC tag area overlap with each other.

5. The embroidery data processing apparatus according to claim 1, further comprising:

a first indication device that, if the determination device determines that the IC tag area can be included in the embroidery area, indicates an includable area which can include the IC tag area out of the embroidery areas; and a selection device that selects the includable area in which the IC tag area is positioned out of the includable areas indicated by the first indication device, wherein the location setting device sets positions of the embroidery area and the IC tag area in the embroiderable area of the sewing machine in such a manner that the IC tag area may be positioned in the includable area selected by the selection device.

6. The embroidery data processing apparatus according to claim 1, further comprising:

a form information acquisition device that acquires form information that represents at least the size and shape of the IC tag, wherein the IC tag area acquisition device acquires the IC tag area which is determined based on at least the form information acquired by the form information acquisition device.

7. The embroidery data processing apparatus according to claim 1, further comprising:

a form information input device that inputs form information that represents at least the size and shape of the IC tag, wherein the IC tag area acquisition device acquires the IC tag area which is determined based on at least the form information inputted by the form information input device.

8. The embroidery data processing apparatus according to claim 1, further comprising:

a needle drop point data acquisition device that acquires needle drop point data indicating a position of a needle drop point for sewing the embroidery pattern on the basis of the embroidery data;

a needle drop point determination device that determines whether there is the needle drop point in the overlap area where the embroidery area and the IC tag area overlap with each other; and an embroidery data modification device that, if the needle drop point determination device determines that there is the needle drop point in the overlap area, modifies the embroidery data so that no needle drop point is in the overlap area.

9. The embroidery data processing apparatus according to claim 8, further comprising:

a turn-around point determination device that determines whether there is a turn-around point, which is the needle drop point where a sewing direction changes, in the overlap area where the embroidery area and the IC tag area overlap with each other, wherein:

if the turn-around point determination device determines that there is no turn-around point in the overlap area, the needle drop point determination device determines whether there is the needle drop point in the overlap area where the embroidery area and the IC tag area overlap with each other; and if the turn-around point determination device determines that there is the turn-around point in the overlap area, the location setting device re-sets positions of the embroidery area and the IC tag area so that the IC tag area is positioned in the embroidery area different from the overlap area.

10. The embroidery data processing apparatus according to claim 8, wherein the embroidery data modification device modifies the embroidery data by changing a stitch width which is employed when the embroidery pattern is embroidered so that there is no needle drop point in the overlap area.

11. The embroidery data processing apparatus according to claim 1, further comprising:

a mark sewing data creation device that creates mark sewing data used to form stitches on the work cloth that serve as an eyemark when positioning the IC tag to the position set by the location setting device.

12. The embroidery data processing apparatus according to claim 1, further comprising:

a reinforcement-stitches data creation device that creates reinforcement-stitches data used to form stitches with which to sew the IC tag to the work cloth at the position set by the location setting device; and a second data addition device that adds the reinforcement-stitches data to a position preceding the embroidery data.

13. The embroidery data processing apparatus according to claim 1, further comprising:

a second indication device that indicates at least either one of a result of a determination made by the determination device and the position determined by the location setting device.

14. An embroidery data processing apparatus which processes embroidery data used to embroider an embroidery pattern on a work cloth by using a sewing machine capable of embroidering, the embroidery data processing apparatus comprising:

an IC tag area acquisition device that acquires an IC tag area which is determined on the basis of a size and shape of an IC tag;

a location specification device that specifies positions of the IC tag area and an embroidery area which are determined on the basis of the embroidery data in an embroiderable area of the sewing machine;

a determination device that determines whether the IC tag area positioned to the position specified by the location specification device is included in the embroidery area positioned at the position specified by the location specification device; and a location setting device that, if the determination device determines that the IC tag area is included in the embroidery area, sets positions of the embroidery area and the IC tag area in the embroiderable area of the sewing machine to the positions specified by the location specification device.

15. The embroidery data processing apparatus according to claim 14, further comprising:

a form information acquisition device that acquires form information that represents at least the size and shape of the IC tag, wherein the IC tag area acquisition device acquires the IC tag area which is determined based on at least the form information acquired by the form information acquisition device.

16. The embroidery data processing apparatus according to claim 14, further comprising:

a form information input device that inputs form information that represents at least the size and shape of the IC tag, wherein the IC tag area acquisition device acquires the IC tag area which is determined based on at least the form information inputted by the form information input device.

17. The embroidery data processing apparatus according to claim 14, further comprising:

a needle drop point data acquisition device that acquires needle drop point data indicating a position of a needle drop point for sewing the embroidery pattern on the basis of the embroidery data;

a needle drop point determination device that determines whether there is the needle drop point in an overlap area where the embroidery area and the IC tag area overlap with each other; and an embroidery data modification device that, if the needle drop point determination device determines that there is the needle drop point in the overlap area, modifies the embroidery data so that no needle drop point is in the overlap area.

18. The embroidery data processing apparatus according to claim 17, further comprising:

a turn-around point determination device that determines whether there is a turn-around point, which is the needle drop point where a sewing direction changes, in the overlap area where the embroidery area and the IC tag area overlap with each other, wherein:

if the turn-around point determination device determines that there is no turn-around point in the overlap area, the needle drop point determination device determines whether there is the needle drop point in the overlap area; and if the turn-around point determination device determines that there is the turn-around point in the overlap area, the location setting device re-sets positions of the embroidery area and the IC tag area so that the IC tag area is positioned in the embroidery area different from the overlap area.

19. The embroidery data processing apparatus according to claim 17, wherein the embroidery data modification device modifies the embroidery data by changing a stitch width which is employed when the embroidery pattern is embroidered so that there is no needle drop point in the overlap area.

20. The embroidery data processing apparatus according to claim 14, further comprising:

a mark sewing data creation device that creates mark embroidering data used to form stitches on the work cloth that serve as a mark when positioning the IC tag to the position set by the location setting device.

21. The embroidery data processing apparatus according to claim 14, further comprising:

a reinforcement-stitches data creation device that creates reinforcement-stitches data used to form stitches with which to sew the IC tag to the work cloth at the position set by the location setting device; and a second data addition device that adds the reinforcement-stitches data to a position preceding the embroidery data.

22. The embroidery data processing apparatus according to claim 14, further comprising:

a second indication device that indicates at least either one of a result of a determination made by the determination device and the position determined by the location setting device.

23. A computer-readable recording medium storing an embroidery data processing computer program which processes embroidery data used to embroider an embroidery pattern on a work cloth by using a sewing machine capable of embroidering, the program comprising:

IC tag area acquisition instructions for acquiring an IC tag area which is determined on the basis of a size and shape of an IC tag;

determination instructions for determining whether the IC tag area can be included in an embroidery area which is determined on the basis of the embroidery data; and location setting instructions for setting positions of the embroidery area and the IC tag area in an embroiderable area of the sewing machine in such a manner that the IC tag area is positioned in the embroidery area if, during execution of the determination instructions, it is determined that the IC tag area can be included in the embroidery area.

24. A computer-readable recording medium storing an embroidery data processing computer program which processes embroidery data used to embroider an embroidery pattern on a work cloth by using a sewing machine capable of embroidering, the program comprising:

IC tag area acquisition instructions for acquiring an IC tag area which is determined on the basis of a size and shape of an IC tag;

location specification instructions for specifying positions of the IC tag area and an embroidery area which are determined on the basis of the embroidery data in an embroiderable area of the sewing machine;

determination instructions for determining whether the IC tag area positioned at the position specified during execution of the location specification instructions is included in the embroidery area positioned at the position specified during execution of the location specification instructions; and location setting instructions for setting positions of the embroidery area and the IC tag area in the embroiderable area of the sewing machine to the positions specified during execution of the location specification instructions if, during execution of the determination instructions, it is determined that the IC tag area can be included in the embroidery area.

* * * * *